US008194865B2

(12) United States Patent
Goldstein et al.

(10) Patent No.: US 8,194,865 B2
(45) Date of Patent: Jun. 5, 2012

(54) METHOD AND DEVICE FOR SOUND DETECTION AND AUDIO CONTROL

(75) Inventors: Steven W. Goldstein, Delray Beach, FL (US); John Usher, Montreal (CA); Dmitry N. Zotkin, Greenbelt, MD (US)

(73) Assignee: Personics Holdings Inc., Boca Raton, FL (US)

( * ) Notice: Subject to any disclaimer, the term of this patent is extended or adjusted under 35 U.S.C. 154(b) by 1110 days.

(21) Appl. No.: 12/035,873

(22) Filed: Feb. 22, 2008

(65) Prior Publication Data

US 2008/0267416 A1 Oct. 30, 2008

Related U.S. Application Data

(60) Provisional application No. 60/891,220, filed on Feb. 22, 2007.

(51) Int. Cl.
*H04R 29/00* (2006.01)

(52) U.S. Cl. ..... 381/56; 381/57; 381/58; 381/72

(58) Field of Classification Search ..... 381/56, 381/57, 58, 72, 74
See application file for complete search history.

(56) References Cited

U.S. PATENT DOCUMENTS

| | | | | |
|---|---|---|---|---|
| 6,023,517 | A * | 2/2000 | Ishige | 381/315 |
| 2004/0155770 | A1 * | 8/2004 | Nelson et al. | 340/531 |
| 2004/0179694 | A1 * | 9/2004 | Alley | 381/55 |
| 2008/0240458 | A1 * | 10/2008 | Goldstein et al. | 381/72 |

* cited by examiner

*Primary Examiner* — Minh-Loan T Tran
(74) *Attorney, Agent, or Firm* — RatnerPrestia

(57) ABSTRACT

Methods and devices for sound detection and audio control are provided. A listening device (100) can include a receiver (102) and a sound director for directing a sound produced by the receiver into an ear of the user, a microphone (104) and a mount for mounting the microphone so as to receive the sound in an environment, a detector for detecting an auditory signal in the sound received by the microphone, and an alerting device for alerting the user to the presence of the auditory signal. The user's personal safety is enhanced due to the user being alerted to the presence of the auditory signal, which otherwise may be unnoticed by the user due to a loud sound level created at the ear of the user by the receiver.

25 Claims, 9 Drawing Sheets

166

Relevance Detecting Unit

METHOD AND DEVICE FOR SOUND DETECTION AND AUDIO CONTROL

CROSS REFERENCE TO RELATED APPLICATIONS

This application is a Non-Provisional Application of and claims the priority benefit of Provisional Application No. 60/891,220 filed on Feb. 22, 2007, the entire disclosure of which is incorporated herein by reference.

FIELD

The present invention generally relates to a device that monitors sounds directed to an ear, and more particularly, though not exclusively, to an earpiece and method of operating an earpiece for warning sound detection and audio control.

BACKGROUND

The human auditory system has been increasingly stressed to tolerate high noise levels to which it had hitherto been unexposed. Recently, human knowledge of the causes of hearing damage have been researched intensively, and models for predicting hearing loss have been developed and verified with empirical data from decades of scientific research. And yet it can be strongly argued that the danger of permanent hearing damage is more present in our daily lives than ever, and that sound levels from personal audio systems in particular (e.g., from portable audio devices), live sound events, and the urban environment are a ubiquitous threat to healthy auditory functioning across the global population. Music reproduction levels and urban noise are antagonistic; we play our personal audio devices louder to hear over the traffic noise. And use of personal audio devices is rapidly increasing, especially in the younger generation who are suffering permanent hearing damage at increasingly younger ages.

Noise is a constant in industrialized societies, given the ubiquity of external sound intrusions, such as people talking on their cell phones, blaring music in health clubs, or the constant hum of HVAC systems in schools and office buildings. To combat the undesired cacophony, consumers are arming themselves with portable audio playback devices to drown out intrusive noise. The majority of devices providing the consumer with audio content do so using insert (or in-ear) earbuds, which deliver sound directly to the ear canal, generating levels sufficient to perceptually mask background noise even though the earbuds provide little to no ambient sound isolation. With earbuds, personal audio reproduction levels can reach in excess of 100 dB; enough to exceed recommended daily sound exposure levels in less than a minute and to cause permanent acoustic trauma. Furthermore, rising population densities have continually increased sound levels in society. According to research, 40% of the European community is continuously exposed to transportation noise of 55 dBA and 20% are exposed to greater than 65 dBA. This level of 65 dBA is considered by the World Health Organization to be intrusive or annoying, and as mentioned, can lead to users of personal audio devices increasing reproduction level to compensate for ambient noise.

Noise exposure can generate auditory fatigue, possibly compromising a person's listening abilities. On a daily basis, people are exposed to various environmental sounds and noises within their environment, such as the sounds from traffic, construction, and industry. Some of the sounds in the environment may correspond to warnings, such as those associated with an alarm or siren. A person that can hear the warning sounds can generally react in time to avoid danger. In contrast, a person that cannot adequately hear the warning sounds, or whose hearing faculties have been compromised due to auditory fatigue, may be susceptible to danger.

Environmental noise can mask warning sounds and impair a person's judgment. Moreover, when people wear headphones to listen to music, or engage in a call using a telephone, they can effectively impair their auditory judgment and their ability to discriminate between sounds. With such devices, the person is immersed in the audio experience and generally less likely to hear warning sounds within their environment. In some cases, the user may even turn up the volume to hear their personal audio over environmental noises. This can put the user in a compromising situation since they may not be aware of warning sounds in their environment. It also puts them at high sound exposure risk which can potentially cause long term hearing damage.

A need therefore exists for enhancing the user's ability to hear warning sounds in the environment and control audio without compromising hearing.

SUMMARY

At least one exemplary embodiment in accordance with the present invention provide a method and device for warning sound detection and audio control.

At least one exemplary embodiment is directed to a listening device (e.g., personal listening device) which can include a) a receiver and means for directing a sound produced by the receiver (e.g., into an ear of a user), b) a microphone and means for mounting the microphone so as to receive the sound in an environment (e.g., an environment surrounding a user), c) detecting means for detecting an auditory signal (e.g., a danger signal) in the sound received by the microphone, and d) alerting means for alerting the user to the presence of the auditory signal detected by the detecting means.

The alerting means can comprise a controllable electronic valve arranged to shut off the receiver upon detection of the auditory signal by the detecting means, whereby enabling the user to hear the auditory signal. The detecting means can comprise a) first means for detecting whether the volume of the sound received by the microphone is more than a predetermined level, b) second means for detecting whether the spectral pattern of the sound received by the microphone is characteristic of the auditory signal, c) third means for detecting whether the temporal pattern of the sound received by the microphone is characteristic of the auditory signal, d) fourth means for detecting whether sound received by the microphone is approaching or receding from the user, and e) fifth means for combining the outputs of the first, second, third, and fourth means. The predetermined level can be set to various levels, for example at least to approximately 65 dB.

The second means can comprise a) means for detecting whether the signal-to-noise ratio is more than approximately 13 dB in at least one one-third-octave-wide frequency band, b) means for detecting whether the signal-to-noise ratio is more than a chosen threshold value (e.g., approximately 10 dB) in at least one one-octave-wide frequency band, and c) means for detecting whether the signal-to-noise ratio is more than a chosen threshold (e.g., approximately 15 dB), all enjoined by the logical OR operator. The third means can comprise a periodicity detector and pitch detector arranged to activate upon detection of a sound with chosen period ranges (e.g., approximately between 0.5 and 4 Hz) and chosen pitch (e.g., approximately between 500 and 1000 Hz), respectively.

The fourth means can be arranged to operate by analyzing sound level over time and by analyzing Doppler shifts in the sound spectrum.

In at least a second exemplary embodiment, a listening device can include a) a receiver and means for directing a sound produced by the receiver into an ear of the user, b) a microphone and means for mounting the microphone so as to receive the sound in an environment (e.g., surrounding a user), c) recognition means for recognizing predetermined environmental sounds, and d) action means for performing predetermined actions upon recognition of the environmental sounds.

The recognition means can comprise a) first means for computing a sound signature of an environmental sound consisting of a vector of numerical values identifying the environmental sound, b) second means for storing a plurality of the sound signatures, and c) third means for comparing the sound signature of the environmental sound with the plurality of sound signatures stored by the second means and for determining a best-matching sound signature. The environmental sounds can be recognized reliably and predetermined actions can be taken upon such recognition. The vector of numerical values can comprise at least one among total power of the environmental sound, powers of the environmental sound in predetermined frequency bands, mel-frequency cepstral coefficients of the environmental sound, a pitch of the environmental sound, a bandwidth of the environmental sound, and a brightness of the environmental sound.

The third means can be arranged to operate using distance between the sound signatures, using a support vector machine (SVM) classifier, using a neural network classifier, or using a mixture of Gaussians classifier. Fourth means can direct the sound signature produced by the first means into the sound signature storage provided by the second means, whereby the personal listening device is accorded an ability to learn, recognize, and act upon recognition of new sound signatures for sounds of interest to the particular user of the device.

Localization means can determine at least one among a location, direction and distance of the environmental sound with respect to the user. The localization means can be arranged to operate using one or more acoustic cues selected from the group comprising a) level (intensity) differences between the signals received at left and right ears, b) phase differences between the signals received at left and right ears, c) level (intensity) variation over time for the signals received at left and right ears, and d) phase variation over time for the signals received at left and right ears.

The action means can comprise one or more means selected from the group comprising a) first means of selectively amplifying the environmental sound recognized by the recognition means, b) second means of selectively attenuating the environmental sound recognized by the recognition means, c) third means of alerting the user to the environmental sound recognized by the recognition means by reciting a textual label pre-associated with the environmental sound to the user by means of a text-to-speech synthesizer, d) fourth means of alerting the user to the environmental sound recognized by the recognition means by rendering a specific sound pre-associated with the environmental sound to the user, e) fifth means of alerting the user to the environmental sound recognized by the recognition means by reciting information indicative of how far and in which direction the environmental sound is located, f) sixth means of alerting the user to the environmental sound recognized by the recognition means by discontinuing the playback of any audio content being played over the personal listening device, and g) seventh means of associating an indicator of which particular action or actions, from the list above, should be executed upon detection of the environmental sound.

In a third exemplary embodiment, a method for constructing an audio listening device can include a) providing a receiver and means for directing a sound produced by the receiver, b) providing a microphone and means for mounting the microphone so as to receive the sound in an environment surrounding the user, c) providing detecting means for detecting an auditory signal in the sound received by the microphone, and d) providing alerting means for alerting the user to the presence of the auditory signal detected by the detecting means. The user's personal safety can be enhanced due to the user being alerted to a presence of the auditory signal, which otherwise may be unnoticed by the user due to a loud sound level created at the ear of the user by the receiver.

The alerting means can be a controllable electronic valve arranged to shut off the receiver upon detection of the auditory signal by the detecting means, whereby enabling the user to hear the auditory signal. The detecting means can include a) first means for detecting whether the volume of the sound received by the microphone is more than a predetermined level, b) second means for detecting whether the spectral pattern of the sound received by the microphone is characteristic of the auditory signal, c) third means for detecting whether the temporal pattern of the sound received by the microphone is characteristic of the auditory signal, d) fourth means for detecting whether sound received by the microphone is approaching or receding from the user, and e) fifth means for combining the outputs of the first, second, third, and fourth means.

In a fourth exemplary embodiment, a method for constructing an audio listening device can include the steps of a) providing a receiver and means for directing a sound produced by the receiver into an ear of the user, b) providing a microphone and means for mounting the microphone so as to receive the sound in an environment surrounding the user, c) providing recognition means for recognizing predetermined environmental sounds, and d) providing action means for performing predetermined actions upon recognition of the environmental sounds.

The recognition means can include a) first means for computing a sound signature of the environmental sound consisting of a vector of numerical values identifying the environmental sound, b) second means for storing a plurality of the sound signatures, and c) third means for comparing the sound signature of the environmental sound with the plurality of sound signatures stored by the second means and for determining the best-matching sound signature. In at least one exemplary embodiment when environmental sounds are recognized, predetermined actions can be taken upon such recognition.

The vector of numerical values can include a total power of the environmental sound, powers of the environmental sound in predetermined frequency bands, mel-frequency cepstral coefficients of the environmental sound, a pitch of the environmental sound, a bandwidth of the environmental sound, and a brightness of the environmental sound. The third means can be arranged to operate using a distance between the sound signatures, for example, using a support vector machine (SVM) classifier, using a neural network classifier, or using a mixture of Gaussians classifier. Fourth means can direct the sound signature produced by the first means into the sound signature storage provided by the second means, whereby the personal listening device is accorded an ability to learn, recognize, and act upon recognition of new sound signatures for sounds of interest to a particular user of the device.

Localization means can determine at least one among a location, direction, and distance of the environmental sound with respect to the user. The localization means can be arranged to operate using one or more acoustic cues selected from the group comprising: a) level (intensity) differences between the signals received at left and right ears, b) phase differences between the signals received at left and right ears, c) level (intensity) variation over time for the signals received at left and right ears, and d) phase variation over time for the signals received at left and right ears.

In a fifth exemplary embodiment, a method for acute sound detection and reproduction (e.g., for use with an earpiece) can include measuring an external ambient sound level in an ear canal, monitoring a change in the external ambient sound level for detecting an acute sound, determining whether a sound source producing the acute sound is approaching or departing, and reproducing the acute sound within the ear canal responsive to the detecting.

The user's listening acuity in relation to sounds of interest to the user can be enhanced by the listening device by means of amplifying those sounds of interest. A user's listening experience can be enhanced by the listening device by means of attenuating the interfering sounds. The user's situation awareness can be enhanced by reciting to him/her the textual label associated with and the location of the environmental sound. The user's personal safety can be enhanced by alerting him/her to specific acoustic signals such as, but not limited to, words in multiple languages indicative of an emergency situation.

BRIEF DESCRIPTION OF THE DRAWINGS

FIG. 1: Listening Device
100 sound-attenuating earplug
102 ear-canal loudspeaker receiver
104 ambient-sound microphone
106 electronic signal processing unit
108 connection to the audio playback device
110 ear-canal microphone
112 external loudspeaker receiver FIG. 2: Block Diagram
102 Ear Canal Receiver (ECR)
104 Ambient Sound Microphone (ASM)
106 Processor
110 Ear Canal Microphone (ECM)
122 Analog to Digital Converter (ADC)
124 Analog to Digital Converter (ADC)
126 Digital to Analog Converter (DAC)
128 Memory
130 Audio Interface
132 Transceiver
134 Location Unit
136 Power Supply FIG. 3: Processor
150 ambient sound input terminal
152 amplifier (AMP)
154 low-pass filter (LPF)
156 analog-to-digital converter (ADC)
158 volume detecting unit (VDU)
160 spectral pattern detecting unit (SPDU)
162 temporal pattern detecting unit (TPDU)
164 localization unit (LU)
166 relevance detection unit (RDU)
168 sound signature extracting unit (SSEU)
170 training mode selector
172 sound signature comparing unit (SSCU)
174 sound signature storage (SSS)
176 sound class selector
178 sound control unit (SCU)
180 playback sound input terminal
182 operation mode selector
184 sound replacement switch
186 ear-canal loudspeaker output terminal FIG. 4: Volume Detecting Unit (VDU)
200 digitized input signal terminal
202 Fourier transform unit
204 signal power computation unit
206 power comparator
208 output terminal FIG. 5: Spectral Pattern Detecting Unit (SPDU)
250 digitized input signal terminal
252 Fourier transform unit
254 third-octave signal bandpass filterbank
256 third-octave signal power computation unit
258 octave signal bandpass filterbank
260 octave signal power computation unit
262 total signal power computation unit
264 noise spectrum accumulator
266 third-octave noise bandpass filterbank
268 third-octave noise power computation unit
270 octave noise bandpass filterbank
272 octave noise power computation unit
274 total noise power computation unit
276 third-octave power comparator
278 octave power comparator
280 total power comparator
282 logic unit
284 "operation-enable" terminal
286 output terminal FIG. 6: Temporal Pattern Detecting Unit (TPDU)
300 digitized input signal terminal
302 Fourier transform unit
304 spectrum accumulation unit
306 two-dimensional Fourier transform unit
308 periodicity detector

310 periodicity comparator
312 pitch detection unit
314 pitch comparator
316 logic unit
318 "operation-enable" terminal
320 output terminal
FIG. 7: Localization Unit (LU)
350 digitized input signal terminal
352 Fourier transform unit
354 signal power computation unit
356 accumulator-comparator
358 pitch detector
360 harmonics extractor
362 Doppler shift detector
364 logic unit
366 "operation-enable" terminal
368 output terminal
FIG. 8: Relevance Detecting Unit (RDU)
400 spectral pattern information terminal
402 temporal pattern information terminal
404 sound direction information terminal
406 logic unit
408 output terminal
FIG. 9: Sound Signature Extracting Unit (SSEU)
450 digitized input signal terminal
452 pre-emphasis filter
454 signal windowing operation (splitter)
456 Fourier transform unit
458 bandpass filterbank
460 triangular filterbank
462 discrete cosine transform unit
464 pitch detector
466 brightness detector
468 bandwidth detector
470 a set of numerical outputs
FIG. 10: Sound Signature Recognition Unit (SSRU)
500 incoming sound signature terminal
502 sound signature difference computation unit
504 sound signature storage connector terminal
506 minimum distance finding unit
508 threshold unit
510 output terminal
FIG. 11: Sound Control Unit (SCU)
550 ambient sound input terminal
552 playback sound input terminal
554 Fourier transform unit
556 ambient sound gating unit
558 selective attenuation unit
560 selective amplification unit
562 inverse Fourier transform unit
564 playback sound gating unit
566 sound signature information terminal
568 danger signal presence information terminal
570 operation mode terminal
572 sound replacement enable terminal
574 logic unit
576 replacement sound playback unit
578 text-to-speech synthesizer
580 summation unit
582 ear-canal loudspeaker output terminal

DETAILED DESCRIPTION

Figure 1:
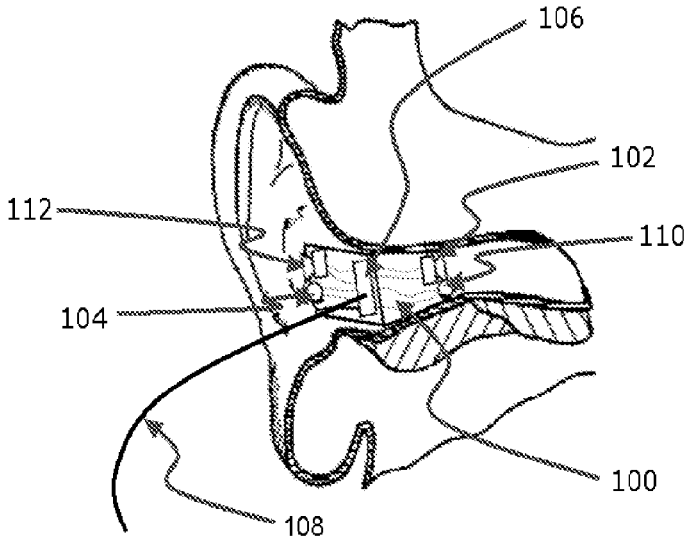
FIG. 1 is a pictorial diagram of a listening device constructed in accordance with an exemplary embodiment.

The following description of at least one exemplary embodiment is merely illustrative in nature and is in no way intended to limit the invention, its application, or uses.

Processes, techniques, apparatus, and materials as known by one of ordinary skill in the relevant art may not be discussed in detail but are intended to be part of the enabling description where appropriate, for example the fabrication and use of transducers.

In all of the examples illustrated and discussed herein, any specific values, for example the sound pressure level change, should be interpreted to be illustrative only and non-limiting. Thus, other examples of the exemplary embodiments could have different values.

Note that similar reference numerals and letters refer to similar items in the following figures, and thus once an item is defined in one figure, it may not be discussed for following figures.

Note that herein when referring to correcting or preventing an error or damage (e.g., hearing damage), a reduction of the damage or error and/or a correction of the damage or error are intended.

Note that discussions herein refer to an earpiece, however exemplary embodiments are not limited to devices for the ear, for example a device in accordance with at least one exemplary embodiment can be a stand alone unit.

At least one exemplary embodiment of the invention is directed to an earpiece for ambient sound monitoring and warning detection. Reference is made to FIG. 1 in which an earpiece device, generally indicated as earpiece 100, is constructed and operates in accordance with at least one exemplary embodiment of the invention. As illustrated, earpiece 100 depicts an electro-acoustical assembly for an in-the-ear acoustic assembly, as it would typically be placed in the ear canal of a user. The earpiece 100 can be an in the ear earpiece, behind the ear earpiece, receiver in the ear, open-fit device, or any other suitable earpiece type. The earpiece 100 can be partially or fully occluded in the ear canal, and is suitable for use with users having healthy or abnormal auditory functioning.

Earpiece 100 includes an Ambient Sound Microphone (ASM) 104 to capture ambient sound, an Ear Canal Receiver (ECR) 102 to deliver audio to the ear canal, and an Ear Canal Microphone (ECM) 110 to assess a sound exposure level within the ear canal. The earpiece 100 can partially or fully occlude the ear canal to provide various degrees of acoustic isolation. The assembly is designed to be inserted into the user's ear canal, and to form an acoustic seal with the walls of the ear canal at a location between the entrance to the ear canal and the tympanic membrane (or ear drum). Such a seal is typically achieved by means of a soft and compliant housing of assembly. Such a seal creates a closed cavity of approximately 5 cc between the in-ear assembly and the tympanic membrane. As a result of this seal, the ECR (speaker) 102 is able to generate a full range bass response when reproducing sounds for the user. This seal also serves to significantly reduce the sound pressure level at the user's eardrum resulting from the sound field at the entrance to the ear canal. This seal is also a basis for a sound isolating performance of the electro-acoustic assembly.

Note that in at least one exemplary embodiment a stand alone system (e.g., not an earpiece) can be used to detect sounds that a listener in a noisy environment can't. Thus, in at least one exemplary embodiment a stand alone device can detect a sound and notify a user or save the occurrence in a database, without sealing the ear canal of a user.

Located adjacent to the ECR 102, is the ECM 110, which is acoustically coupled to the (closed) ear canal cavity. One of its functions is that of measuring the sound pressure level in the ear canal cavity as a part of testing the hearing acuity of the user as well as confirming the integrity of the acoustic seal and the working condition of the earpiece 100. In one arrangement, the ASM 104 can be housed in the ear seal to monitor sound pressure at the entrance to the occluded or partially occluded ear canal. All transducers shown can receive or transmit audio signals to a processor 106 that undertakes audio signal processing and provides a transceiver for audio via the wired or wireless communication path 108.

Briefly, the earpiece 100 can actively monitor a sound pressure level both inside and outside an ear canal and enhance spatial and timbral sound quality while maintaining supervision to ensure safe sound reproduction levels. The earpiece 100 in various embodiments can conduct listening tests, filter sounds in the environment, monitor warning sounds in the environment, present notification based on identified warning sounds, maintain constant audio content to ambient sound levels, and filter sound in accordance with a Personalized Hearing Level (PHL).

The earpiece 100 can generate an Ear Canal Transfer Function (ECTF) to model the ear canal using ECR 102 and ECM 110, as well as an Outer Ear Canal Transfer function (OETF) using ASM 104. For instance, the ECR 102 can deliver an impulse within the ear canal and generate the ECTF via cross correlation of the impulse with the impulse response of the ear canal. The earpiece 100 can also determine a sealing profile with the user's ear to compensate for any leakage. It also includes a Sound Pressure Level Dosimeter to estimate sound exposure and recovery times. This permits the earpiece 100 to safely administer and monitor sound exposure to the ear. Additionally, an external loudspeaker 112 can be placed on the outer (environment-facing) surface of the earpiece 100 for performing other functions of the headphone, such as monitoring of sound exposure and ear health conditions, headphone equalization, headphone fit testing, noise reduction, and customization.

Figure 2:
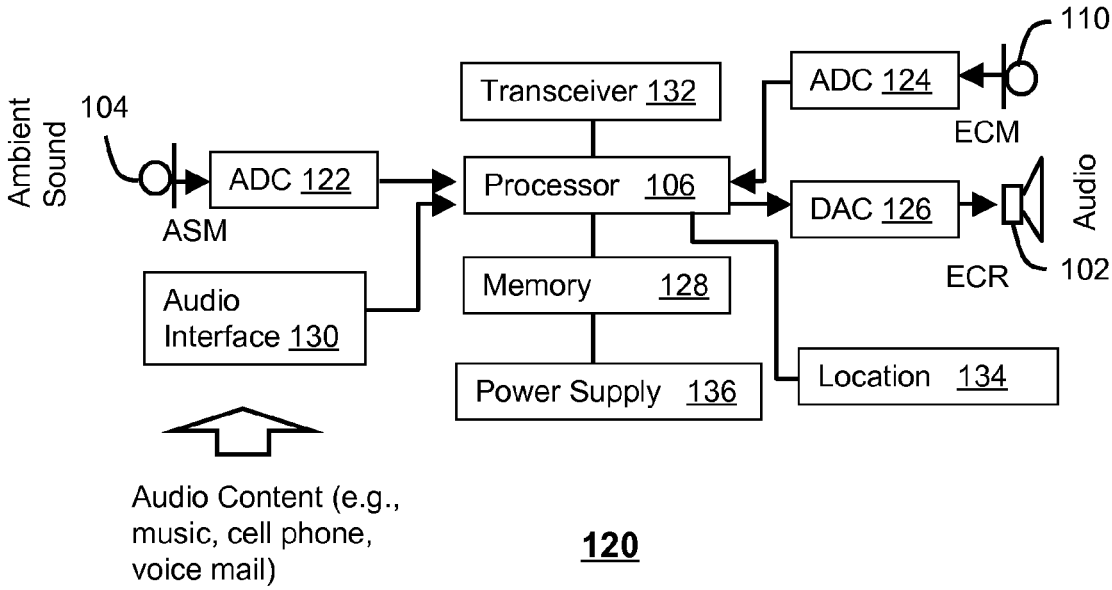
FIG. 2 is a block diagram of the listening device in accordance with an exemplary embodiment.

Referring to FIG. 2, a block diagram 120 of the earpiece 100 in accordance with an exemplary embodiment is shown. As illustrated, the earpiece 100 can include the processor 106 operatively coupled to the ASM 104, ECR 102, and ECM 110 via one or more Analog to Digital Converters (ADC) 122 and 124 and Digital to Analog Converters (DAC) 126. The processor 106 can utilize computing technologies such as a microprocessor, Application Specific Integrated Chip (ASIC), and/or digital signal processor (DSP) with associated storage memory 128 such a Flash, ROM, RAM, SRAM, DRAM or other like technologies for controlling operations of the earpiece device 100. The processor 106 can also include a clock to record a time stamp.

The earpiece 100 can measure ambient sounds in the environment received at the ASM 104. Ambient sounds correspond to sounds within the environment such as the sound of traffic noise, street noise, conversation babble, or any other acoustic sound. Ambient sounds can also correspond to industrial sounds present in an industrial setting, such as, factory noise, lifting vehicles, automobiles, and robots to name a few.

Although the earpiece 100 when inserted in the ear can partially occlude the ear canal, the earpiece 100 may not completely attenuate the ambient sound. The passive aspect of the physical earpiece 100, due to the mechanical and sealing properties, can provide upwards of a 22 dB noise reduction. However, portions of ambient sounds higher than the noise reduction level can still pass through the earpiece 100 into the ear canal thereby producing residual sounds. For instance, high energy low frequency sounds may not be completely attenuated. Accordingly, residual sound may be resident in the ear canal and measured by the ECM 110.

The memory 128 can also store program instructions for execution on the processor 106 as well as captured audio processing data. For instance, memory 128 can be off-chip and external to the processor 106, and include a data buffer to temporarily capture the ambient sound and the internal sound, and a storage memory to save from the data buffer the recent portion of the history in a compressed format responsive to a directive by the processor 106. It should also be noted that the data buffer can in one configuration reside on the processor 106 to provide high speed data access. The storage memory can be non-volatile memory such as SRAM to store captured or compressed audio data.

The earpiece 100 can include an audio interface 130 operatively coupled to the processor 106 to receive audio content, for example from a media player or cell phone, and deliver the audio content to the processor 106. The processor 106 responsive to detecting events can adjust the audio content delivered to the ear canal. For instance, the processor 106 can lower a volume of the audio content responsive to detecting an event for transmitting the sound to the ear canal. The processor 106 by way of the ECM 110 can also actively monitor the sound exposure level inside the ear canal and adjust the audio to within a safe and subjectively optimized listening level range.

The earpiece 100 can further include a transceiver 132 that can support singly or in combination any number of wireless access technologies including without limitation Bluetooth™, Wireless Fidelity (WiFi), Worldwide Interoperability for Microwave Access (WiMAX), and/or other short or long range communication protocols. The transceiver 132 can also provide support for dynamic downloading over-the-air to the earpiece 100. It should be noted also that next generation access technologies can also be applied to the present disclosure.

The location receiver 134 can utilize common technology such as a common GPS (Global Positioning System) receiver that can intercept satellite signals and therefrom determine a location fix of the earpiece 100.

The power supply 136 can utilize common power management technologies such as replaceable batteries, supply regulation technologies, and charging system technologies for supplying energy to the components of the earpiece 100 and to facilitate portable applications. A motor (not shown) can be a single supply motor driver coupled to the power supply 136 to improve sensory input via haptic vibration. As an example, the processor 106 can direct the motor to vibrate responsive to an action, such as a detection of a warning sound or an incoming voice call.

The earpiece 100 can further represent a single operational device or a family of devices configured in a master-slave arrangement, for example, a mobile device and an earpiece. In the latter embodiment, the components of the earpiece 100 can be reused in different form factors for the master and slave devices.

Figure 3:
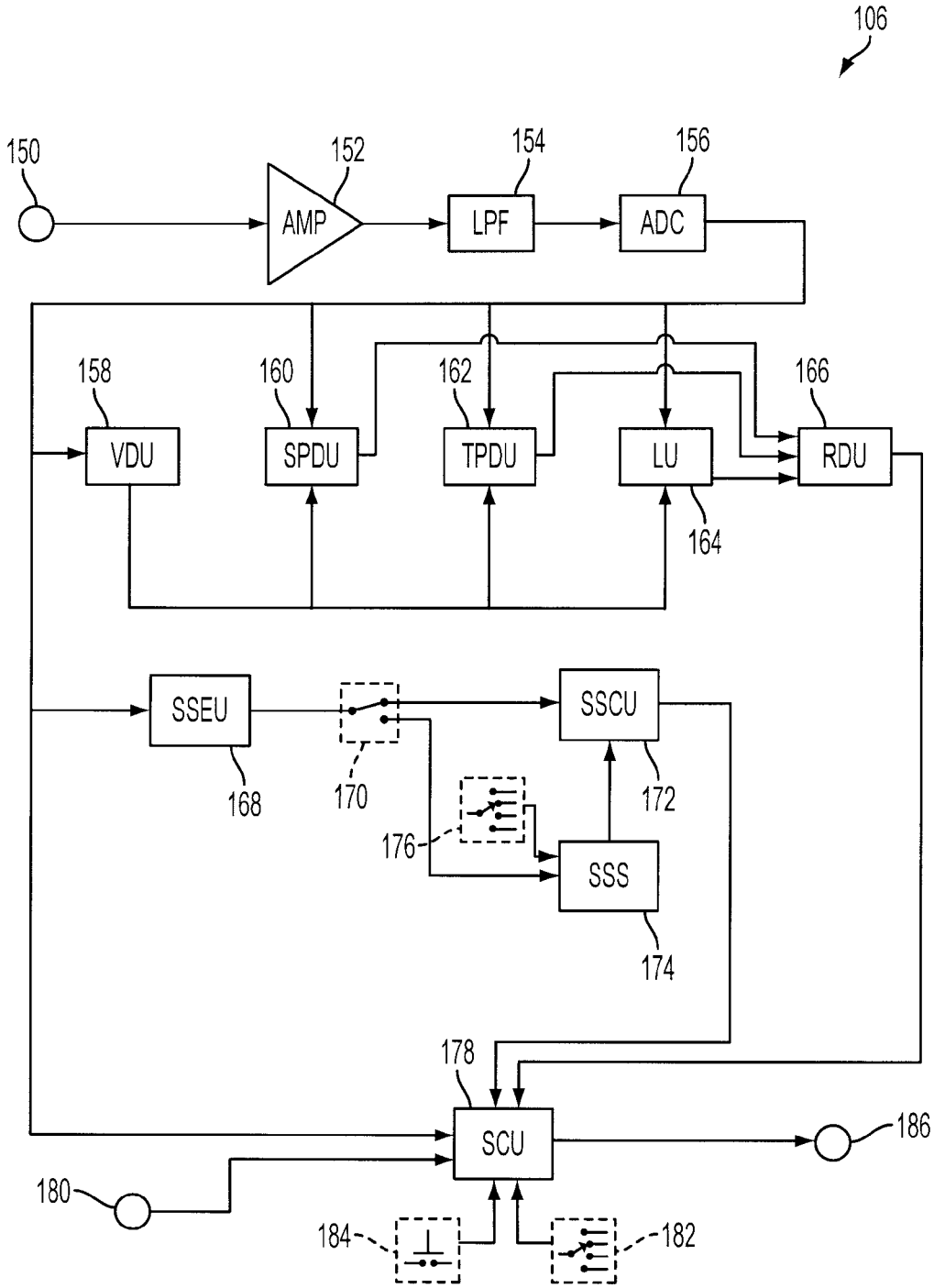
FIG. 3 is a block diagram of an electronic signal processing unit of a listening device constructed in accordance with an exemplary embodiment.

The signal processing unit 106 is an electronic component that can operate in accordance with the block diagram shown in FIG. 3. Referring now to FIG. 3, a structural scheme of the processing done within the signal processing unit is shown. Specifically, the input part of the processing consists of a terminal 150 onto which the signal arriving from the microphone 104 is connected; the amplifier (AMP) 152 can amplify the microphone signal; the low-pass filter (LPF) 154 can suppress aliasing effects during digitization of the following step; and the analog-to-digital (ADC) converter 156, can convert the sound wave into the digital format for further processing.

The digitized ambient sound is fed to two circuits depicted in FIG. 3. The top circuit (comprised of units 158, 160, 162, 164, and 166) performs recognition of auditory signals per specifications set in ISO 7731, "Ergonomics—Danger signals for public and work areas—Auditory signals", second edition dated Nov. 1, 2003. The bottom circuit (comprised of units 168, 170, 172, 174, and 176) detects by means of sound signature comparison other signals of interest to the system. Briefly, embodiments for the detailed structure of blocks 158, 160, 162, 164, 166, 168, 172, and 178 are presented ahead in FIGS. 4 through 11, respectively.

Specifically, the output of the analog-to-digital converter 156 can be connected to the volume detector unit (VDU) 158, to the spectral pattern detecting unit (SPDU) 160, to the temporal pattern detecting unit (TPDU) 162, and to the localization unit (LU) 164. The volume detector 158 determines whether the detected signal power is above a power threshold, for example, given in ISO 7731. If this condition is satisfied, the volume detector outputs the "true" flag. The output of the volume detector 158 is connected, in parallel, to the "operation-enable" inputs of the spectral pattern detecting unit 160, to the temporal pattern detecting unit 162, and to the localization unit 164. Thus, unit 160, 162, and 164 do not operate until and unless the volume detector 158 detects the signal of sufficient power. The spectral pattern detecting unit 160 determines whether the spectral properties of the signal, such as power in octave or third-octave bands, for example, conform to the ISO 7731 standard. The temporal pattern detecting unit 162 determines whether the temporal properties of the signal, such as pulsation rate, for example, conform to the ISO 7731 standard. The localization unit 164 determines whether the signal appears to be approaching or receding. Outputs of the units 160, 162, and 164 are connected to the relevance detecting unit (RDU) 166, which detects whether the signal is indeed a non-receding danger signal and therefore warrants an action. Output of the relevance detecting unit 166 is connected to the sound control unit 178, which is described later in this section.

The output of the analog-to-digital converter 156 is also connected to the sound signature extracting unit (SSEU) 168. It is used to extract the digital vector of the features of the ambient sound received via terminal 150. These features are said to comprise the "sound signature". The sound signature storage (SSS) 174 stores the digital signatures for the plurality of the sounds that are of interest to the system. Also, with each signature, an indicator of the class of sound having three possible values ("alert word", "desired sound", or "undesired sound") and optional sound replacement information for the signal is stored. Sound replacement information consists of either the alternative sound (to be rendered to the user) or the textual label (to be recited to the user) when the sound of interest is detected in the environment. A learning-mode switch 170 is used to direct the extracted sound signature to the storage 174 for recording, thereby enabling the system to learn sound signatures for signals of relevance to the user. A sound class switch 176 is used along with the switch 170 in the learning mode to let the system know the intention of the user as to whether the signal being taught to the system is an alert word, is a desirable sound, or is an undesirable sound.

If switch 170 is not pressed, the output of the sound signature extractor unit 168 is connected to the sound signature comparing unit (SSCU) 172, which also has as an input the signature storage 174 with signatures for all sounds of relevance. The output of the sound signature comparing unit 172 consists of the four-valued flag indicating the recognition result (no signal detected, alert word detected, desired signal detected, or undesired signal detected), of an optional sound replacement information for the signal, and of a list of particular frequency bands which are occupied by the sound if one is detected. It is connected to the sound control unit 178.

The output of the analog-to-digital converter 156 is also connected to the sound control unit 178. The sound control unit (SCU) 178 also receives the detection results from the auditory signals detection circuit (output of the unit 166) and from the desired/undesired signals detection circuit (output of the unit 172). The playback sound input terminal 180 and the ear canal loudspeaker output terminal 186 are connected to the sound control unit 178. The user-selectable switch 182 selects the mode of operation for the sound control unit. Possible modes of operation are transparency, amplification, attenuation, and playback. Another user-selectable switch 184 is used to turn on sound replacement mode. The recognition results from outputs of unit 166 and of unit 172 together with the positions of switches 182 and 184 determine the action or actions to be done by the sound control unit 178. The possible actions are: mute the audio playback; selectively amplify the ambient sound in the given frequency bands; selectively attenuate the ambient sound in the given frequency bands; replace the sound according to the sound replacement information associated with it (i.e., by rendering the associated replacement sound or applying text-to-speech conversion to the associated textual label); and announce the location of the detected sound (such as "left, 20 feet") via text-to-speech conversion.

In the foregoing, a brief description of the earpiece 100 and its operation is presented with respect to FIGS. 1-3 in accordance with embodiments of the invention. Ambient sound is acquired by the microphone 104 (see FIG. 1) and enters the electronic control unit via the terminal 150 (see FIG. 3). The signal is amplified by amplifier 152, is low-passed by a low-pass filter 154 with the cut-off of half the discretized frequency to avoid aliasing, and is converted to the digital form via the analog-to-digital converter 156. It is then sent to two independently operating circuits (top and bottom parts of FIG. 3) designed to recognize specifically auditory signals and all other signals of interest, respectively.

In the top circuit (150-166), the signal is processed for detection of auditory signals (such as ambulance or fire truck siren). The signal is analyzed in the manner similar to how humans detect the presence of danger signals in the environment. The signal is subject to several consecutive tests considering its power, its spectral and temporal characteristics, and its motion direction, if any. Specifically, the signal is first submitted to the volume detecting unit 158. It determines whether the volume of the signal and the signal-to-noise ratio are sufficiently high to warrant an action, by comparing those characteristics with thresholds, for example, set forth in ISO 7731. If the signal is determined to be sufficiently loud, it is passed along to the output of the volume detecting unit 158 and is sent, in parallel, to three units for further determining the compliance, for example, with ISO 7731 and the relevance of the signal.

The signal is analyzed by the spectral pattern detecting unit 160 for determining if the signal has high power in one or more narrow frequency bands, suggesting a siren-type or horn-type signal. The signal is also analyzed by the temporal pattern detecting unit 162 for determining if the signal has periodic pulsations in power or in spectral peak position, which is also characteristic of auditory signals. Both of these units output a flag indicating whether patterns characteristic for auditory signals are detected. The signal is also analyzed by the localization unit 164 for determining via Doppler shift analysis and via signal power analysis over time whether the signal is approaching or receding. Unit 164 also outputs a binary value indicative of the result of analysis. Outputs of units 160, 162, and 164 are sent to the relevance detecting unit 166. It makes a decision of whether the auditory signal is present and whether it is relevant to the user (e.g., receding signal is not relevant). If the signal is deemed to be relevant, a command is sent to the sound control unit 178 directing it to mute the audio playback and to switch to the transparency mode to allow the user of the system to hear the danger signal, which can otherwise be obscured by music playback. This concludes the discussion of the operation of the top circuit of FIG. 3 (units 158, 160, 162, 164, and 166).

The bottom circuit of FIG. 3 (units 168, 170, 172, 174, and 176) performs detection of sounds by means of sound signature comparison. Sounds of interest to the system are divided into three broad classes: alert words, desired sounds, and undesired sounds. Example of alert words are words like "fire", "police", "traffic accident", and similar words in multiple languages. When an alert word is detected, the playback is stopped and a word itself or the sound replacement information associated with it (such as an alert signal or translation of the word) is rendered to the user, depending on the position of switch 184. Examples of a desired sound may be a name of the user, footsteps sound, gun cock sound, or a sound of bicycle bell. A reaction for the desired sound is its amplification and/or announcement of such sound being detected. Undesired sounds may include a sound of a train whistle or train bells announcing the train arrival at the station or the sound of dentist drill in the dentist's office. The reaction to the undesired sound is its attenuation so that the interference caused by it is kept minimal. The system is also accorded with the ability to train itself with the new sounds of interest to the particular user (e.g., a person who does not want to skip the weather forecast on TV can tune his system to the characteristic music happening at the start of forecast and make this sound desired).

Specifically, for the signature-based sound recognition, the input sound to the system is sent to the unit 168, which computes the numeric vector comprising the sound signature of the ambient sound. Under normal mode of operation (the training mode switch 170 is not pressed), the numeric sound signature is sent to the sound signature comparing unit 172. Unit 172 compares it to the sound signatures stored in the sound signature storage 174. Unit 174 stores the sound signatures for a sound of interest together with the sound class indicator ("alert word", "desired sound", or "undesired sound") and with optional sound replacement information for each signature. Unit 174 may be pre-programmed with sound signatures most suitable for an average user (e.g., has several alert words stored in most common languages). In addition, sound pertinent to a certain user profile (such as a sound of a bicycle bell for joggers) can be pre-stored or downloaded later on a per-user basis, and the system can learn additional sounds of interest to the particular user by using the learning mode selectable by the switch 170. Unit 172 finds, from all signatures stored in the storage 174, the sound signature that is the most similar to the incoming sound signature. It also computes the degree of certainty of the decision that the sound found in the storage is actually present in the ambient signal. If the degree of certainty is more than a set threshold, the sound corresponding to the best-matching sound signature is deemed to be present in the environment and the unit 172 outputs the information associated with the sound (sound class, sound replacement information if any, and the list of frequency bands occupied by the detected sound).

Under "learning" mode of operation (switch 170 is pressed), the sound signature of the ambient sound is sent to unit 174 for storage for later use. In this way, the system learns additional "sounds of interest" for the particular user of the system. When exposing the system to the "sound of interest", the user also uses the switch 176 to tell the system whether the sound being taught is an "alert word" and should cause stop of the music playback when encountered, is "desirable" and should be amplified when encountered, or is "undesirable" and should be attenuated when encountered. This information is stored in the indicator associated with each sound signature in storage 174.

Figure 4:
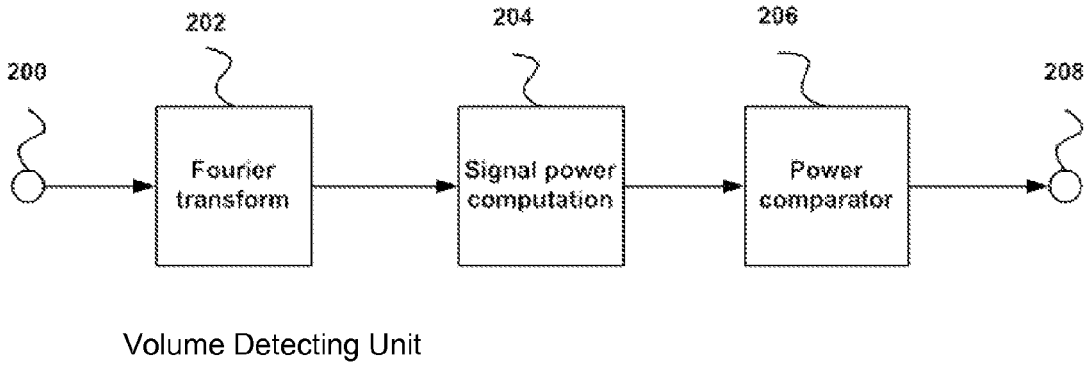
FIG. 4 is a block diagram of a volume detecting unit as shown in FIG. 3 in accordance with an exemplary embodiment.

Referring to FIG. 4, a block diagram for an exemplary embodiment of the volume detecting unit 158 is shown. The volume detecting unit 158 includes an input terminal 200 for input of the digitized ambient audio signal frame. The terminal 200 is connected to the Fourier transform unit 202, which computes the spectrum of the frame of the signal. The output of the Fourier transform unit 202 is connected to the signal power computation unit 204. The output of the signal power computation unit 204 is connected to the power threshold unit 206. The output of unit 206 is connected to the output terminal 208 of the volume detecting unit 158.

The volume detecting unit 158 is involved in recognition of auditory signals. There are several constraints imposed on auditory signals in ISO 7731 international standard. The volume detecting unit 158 verifies a first of those constraints—specifically, that the signal power is more than the absolute threshold of 65 dB. The volume detecting unit operates as follows.

The frame of the digitized input sound arrives via terminal 200. The Fourier transform unit 202 obtains the spectrum of the frame and passes it on to the signal power computation unit 204, which computes the power of the signal in dB. The computed value of power is transmitted to the power comparator 206, which outputs "true" if the signal power is more than a pre-determined value of 65 dB and "false" otherwise. The output of the power comparator 206 is finally sent to the output terminal 208. If the signal sent is "true", it means that a sufficiently high-volume signal is presented in the environment. The signal enables operation of three other units (spectral pattern detection unit 160 (FIG. 3), temporal pattern detection unit 162, and localization unit 164) to analyze the signal further as to whether the signal is an auditory signal or not.

Figure 5:
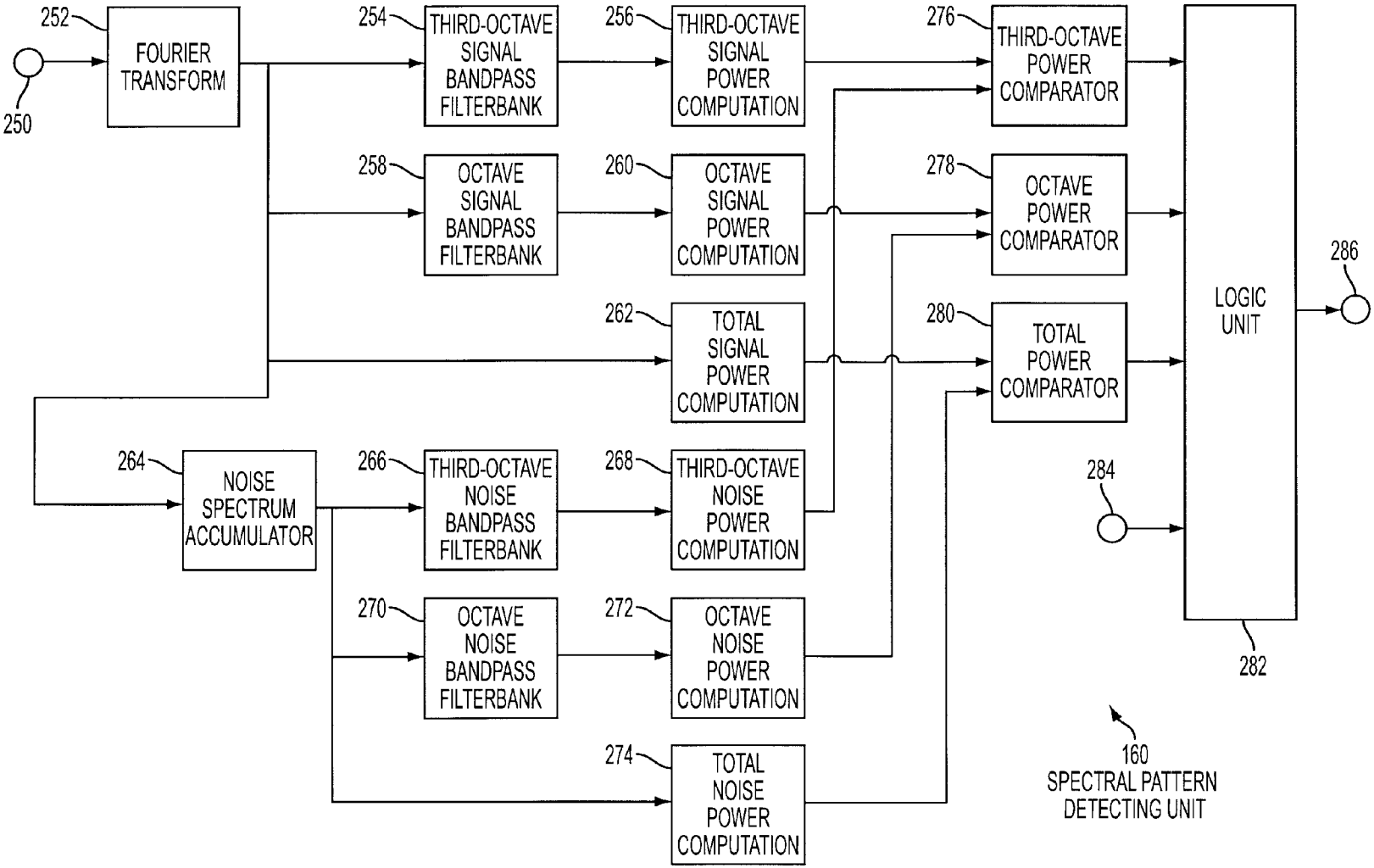
FIG. 5 is a block diagram of a spectral pattern detecting unit as shown in FIG. 3 in accordance with an exemplary embodiment.

Referring to FIG. 5, a block diagram of the spectral pattern detecting unit 160 according to one embodiment is shown. The spectral pattern detecting unit 160 is responsible for detecting the specific spectral patterns prescribed for auditory signals, for example by the ISO 7731 standard. The terminal 250 serves as the input for the audio signal. The input terminal 250 is connected to the Fourier transform unit 252, which computes the spectrum of the incoming sound frame.

The output of the unit 252 is connected to the third-octave signal bandpass filterbank 254 containing one-third-octave-wide filters spanning the signal frequency range. The output of the filterbank 254 is connected to the third-octave signal power computation unit 256. The output of the unit 252 is also connected to the octave signal bandpass filterbank 258 containing octave-wide filters spanning the signal frequency range. The output of the filterbank 258 is connected to the octave signal power computation unit 260. The output of the unit 252 is also connected to the total signal power computation unit 262.

The output of the unit 252 is also connected to the noise spectrum accumulation unit 264. The output of the noise spectrum accumulation unit 264 is connected to the third-octave noise bandpass filterbank 266 containing one-third-octave-wide filters spanning the signal frequency range. The output of the filterbank 266 is connected to the third-octave noise power computation unit 268. The output of the unit 264 is also connected to the octave noise bandpass filterbank 270 containing octave-wide filters spanning the signal frequency range. The output of the filterbank 270 is connected to the octave noise power computation unit 272. The output of the unit 264 is also connected to the total noise power computation unit 274.

The outputs of the third-octave signal power computation unit 256 and of the third-octave noise power computation unit 268 are connected to the third-octave power comparator 276. The outputs of the octave signal power computation unit 260 and of the octave noise power computation unit 272 are connected to the octave power comparator 278. The outputs of the total signal power computation unit 262 and of the total noise power computation unit 274 are connected to the total power comparator 280. The outputs of the comparators 276, 278, and 280 are connected to the logic unit 282. The "operation-enable" terminal 284 is also connected to the logic unit 282. The logic unit 282 operates according to the rules described in the next section. The output terminal 286 of the spectral pattern detecting unit is connected to the output of the logic unit 282 signaling the detection of the spectral pattern characteristic of an auditory signal.

In the foregoing, a brief description of the operation of the spectral pattern detecting unit 160 is provided. The input signal arrives into the spectral pattern detecting unit via input terminal 250. The signal is subject to the Fourier transform in the unit 252, generating the spectrum of the signal frame. The spectrum of the signal is then sent to the filter-bank 254 and subsequently to the power computation unit 256, which outputs the list of signal power in third-octave frequency bands spanning the signal frequency range. The spectrum of the signal is also sent to the filter-bank 258 and subsequently to the power computation unit 260, which outputs the list of signal power in octave frequency bands spanning the signal frequency range. The spectrum of the signal is also sent to the total power computation unit 262, which outputs the total power of the signal in the entire frequency range.

For the purposes of estimating the environmental noise level, the spectrum of the signal is also sent to the noise power accumulation unit 264. The noise power accumulation unit 264 accepts the spectrum of the sound and computes the running estimate of the average spectrum power over a time window of 1 minute. This running estimate is deemed to be the noise power spectrum and is used in several other units of the volume detector for computing the signal-to-noise ratio of the detected signal.

The noise spectrum (from the output of unit 264) is subject to the same computations as the signal spectrum. Specifically, the noise spectrum is sent to the filter-bank 266 and subsequently to the power computation unit 268, which outputs the list of noise power in third-octave frequency bands spanning the signal frequency range. The noise spectrum is also sent to the filter-bank 270 and subsequently to the power computation unit 272, which outputs the list of noise power in octave frequency bands spanning the signal frequency range. The noise spectrum is also sent to the total noise power computation unit 274, which outputs the total noise power.

The computed third-octave power of the signal (output by unit 256) and third-octave power of the noise (output by unit 268) is sent to the third-octave power comparator 276. The comparator 276 operates according to the following rule. The comparator 276 outputs "true" if in at least one third-octave band the signal level is more than the effective masked threshold (computed from the noise power) by at least 13 dB. One set of rules for computing effective masked threshold are established in ISO 7731.

The computed octave power of the signal (output by unit 260) and octave power of the noise (output by unit 272) is sent to the octave power comparator 278. The comparator 278 operates according to the following rule. The comparator 278 outputs "true" if in at least one octave band the signal level is more than the effective masked threshold (computed from the noise power) by at least 10 dB. One set of rules for computing effective masked threshold are established in ISO 7731.

The computed total power of the signal (output by unit 262) and total power of the noise (output by unit 274) is sent to the total power comparator 280. The comparator 280 operates according to the following rule. The comparator 280 outputs "true" if the signal level is more than the noise level by at least 15 dB.

The outputs of the comparators 276, 278, and 280 are sent to the logic unit 282. The logic unit 282 also accepts input from "operation-enable" terminal 284. The logic unit 282 operates according to the following rules:

a) If the "operation-enable" input 284 is "false", the output of the unit 282 is "false".

b) If the "operation-enable" input 284 is "true" and the input from at least one of the comparators 276, 278, and 280 is "true", the output of the unit 282 is "true".

c) Otherwise, the output of the unit 282 is "false".

The "operation-enable" terminal can also be used to disable operation of the spectral pattern detecting unit 160 altogether by, e.g., putting the semiconductor components comprising the unit into low-power-consumption ("sleep") mode so as to conserve power for unattached operations.

The output of the unit 282 is sent to the output terminal 286 to signal to the further circuits whether the environmental signal exhibits spectral properties characteristic of danger signals, for example, in accordance with ISO 7731.

Figure 6:
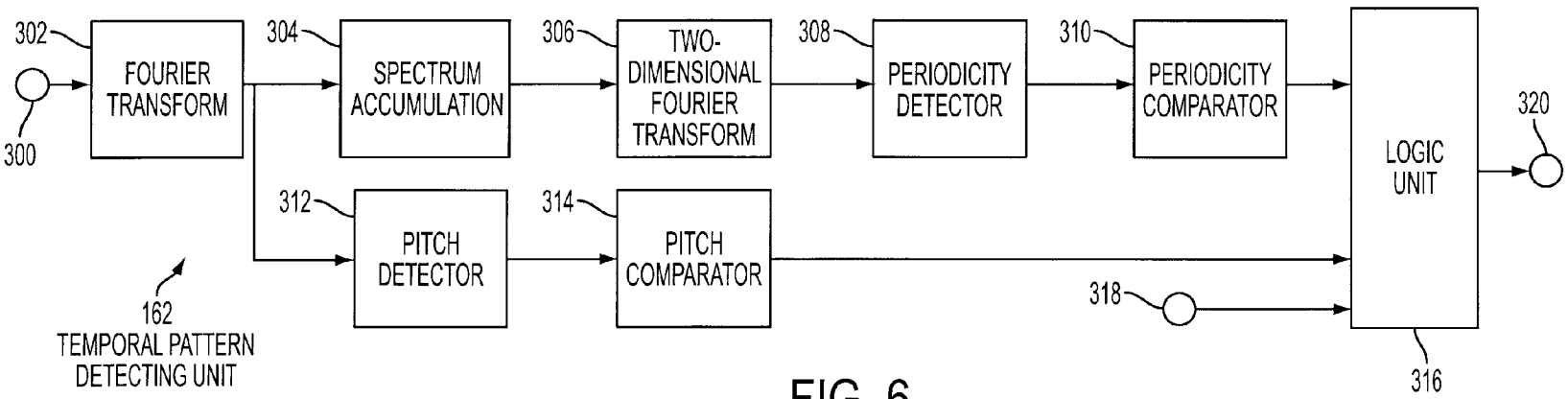
FIG. 6 is a block diagram of a temporal pattern detecting unit as shown in FIG. 3 in accordance with an exemplary embodiment.

Referring to FIG. 6, a block diagram of the temporal pattern detecting unit 162 according to one embodiment is shown. The temporal pattern detecting unit 162 is responsible for detecting the specific temporal patterns prescribed for auditory signals, for example, by ISO 7731 standard. The terminal 300 serves as the input for the audio signal. The input terminal 300 is connected to the Fourier transform unit 302, which computes the spectrum of the incoming sound frame. The output of the Fourier transform unit 302 is connected to the spectrum accumulation unit 304, which keeps a first-in, first-out queue of spectra of recently seen frames. The output of the spectrum accumulation unit 304 is connected to the two-dimensional Fourier transform unit 306. The output of the Fourier transform unit 306 is connected to the periodicity detector 308, which output is connected to the periodicity comparator 310. The output of the periodicity comparator 310 is submitted to the logic unit 316.

The output of the Fourier transform unit 302 is also connected to the pitch detector 312. The output of the pitch detector 312 is connected to the pitch comparator 314. The output of the pitch comparator 314 is also submitted to the logic unit 316. The logic unit 316 accepts inputs from the periodicity comparator 310, from the pitch comparator 314, and from the "operation-enable" input terminal 318. The logic unit 316 operates in accordance with the rules fully described in the next section. The output of the logic unit is connected to the output terminal 320 of the temporal pattern detecting unit 162.

In the foregoing, a brief description of the operation of the temporal pattern detecting unit 162 is provided. The digitized frame of the ambient sound arrives into the temporal pattern detecting unit via terminal 300. The signal is converted to the frequency domain in the Fourier transform unit 302. The spectrum of the sound is sent from the Fourier transform unit 302 to the spectrum accumulator 304. The spectrum accumulator 304 keeps a number of recently received spectrums in the first-in, first-out (queue-type) data structure so that at any given moment of time the spectrum accumulator holds most recently seen spectrums for the last 4 seconds. The spectrum accumulator 304 outputs then in the two-dimensional format as an array where the spectrums are placed in rows of the two-dimensional array. This array can be thought of as an image with brightness of the pixel being the power of the spectrum at a given time and frequency, the X-axis being the frequency, and the Y-axis being the time. A two-dimensional Fourier transform on such an image would reveal the periodicity of image structure. Thus, the array of most recently seen spectrums is sent out of the spectrum accumulator 304 to the two-dimensional Fourier transform unit 306, which (by definition of the two-dimensional Fourier transform) produces as the output the two-dimensional array of Fourier transform coefficients. This array is submitted to the periodicity detector 308, which searches for the pronounced peak(s) in it. If the ratio of peak magnitude to the average magnitude over the array of two-dimensional Fourier transform coefficients is higher than a set threshold, then the frequency location of the highest peak detected is sent to the periodicity comparator 310. The periodicity comparator 310 ensures that the frequency of periodicity is in agreement with a pulsation/sweep frequency prescribed for auditory signals, for example in the ISO 7731 standard, that is specifically between 0.5 and 4 Hz. If that is the case, the periodicity comparator 310 outputs "true". Otherwise, or if there is no output at the output of the periodicity detector 308, the periodicity comparator 310 outputs "false".

The spectrum of the sound is also sent from the Fourier transform unit 302 to the pitch detector 312, which is a device well-known to one skilled in art. The pitch detector 312 executes a numeric pitch detection algorithm and outputs the pitch frequency of the signal to the pitch comparator 314. The pitch comparator 314 verifies that the pitch of the signal is in agreement with the pitch prescribed for auditory signals, for example in the ISO 7731 standard, that is specifically between 500 and 1000 Hz. If that is the case, the pitch comparator 314 outputs "true". Otherwise, or if the pitch detector 312 determines that the signal is pitchless, the pitch comparator 314 outputs "false".

The outputs of the comparators 310 and 314 are sent to the logic unit 316. The logic unit 316 also accepts input from "operation-enable" terminal 318. The logic unit 316 operates according to the following rules:

a) If all three inputs are "true", the output of the unit 316 is "true".

b) Otherwise, the output of the unit 316 is "false".

In accordance with these rules, the "false" signal on the "operation-enable" terminal 318 inhibits output for the temporal pattern detecting unit 162. The "operation-enable" terminal 318 can also be used to disable operation of the temporal pattern detecting unit 162 altogether by, e.g., putting the semiconductor components comprising the unit into low-power-consumption ("sleep") mode so as to conserve power for unattached operations. If the "operation-enable" terminal 318 is "true", the output of the logic control unit 316 is "true" if and only if both the periodicity and the pitch of the ambient auditory signal conform, for example, to the ISO 7731 standard.

The output of the unit 316 is sent to the output terminal 320 to signal to the further circuits whether the environmental signal exhibits temporal properties characteristic of danger signals, for example, in accordance with ISO 7731.

Figure 7:
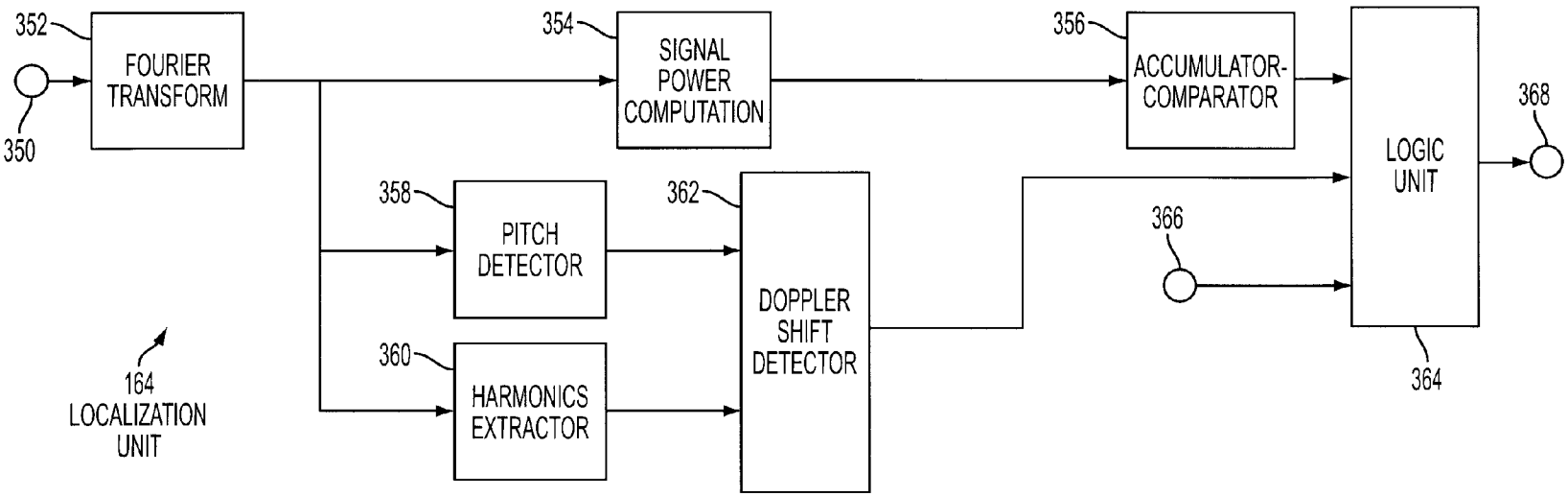
FIG. 7 is a block diagram of a localization unit as shown in FIG. 3 in accordance with an exemplary embodiment.

Referring to FIG. 7, a block diagram of the localization unit 164 according to one embodiment is shown. The input for the localization unit is a terminal 350 (digitized input signal terminal). It is connected to the Fourier transform unit 352. The output of the Fourier transform unit 352 is connected to the signal power computation unit 354. The output of the power computation unit 354 is connected to the accumulator-comparator 356, which evaluates whether the volume of the detected signal is increasing or decreasing over time. The output of the accumulator-comparator is connected to the logic unit 364.

The output of the Fourier transform unit 352 is also connected, in parallel, to the pitch detector 358 and to the harmonics extractor 360. The output of both blocks 358 and 360 is connected to the Doppler shift detector 362. The Doppler shift detector 362 determines whether the signal is approaching or receding via comparison between the extracted pitch value and the frequencies of harmonics in the sound. The output of the Doppler shift detector 362 is also connected to the logic unit 364.

The logic unit 364 is processing the outputs of the accumulator-comparator 356 and of the Doppler shift detector 362 according to the operation rules fully described in the following subsection. The "operation-enable" terminal 366 is also connected to the logic unit 364. The output of the logic unit 364 is applied to the terminal 368 indicating whether the signal is approaching or receding for later use in the relevance detection unit 166 (FIG. 3).

In the foregoing, a brief description of the operation of the localization unit 164 is provided. The input for the localization unit is the terminal 350. The digitized frame of the input signal arrives via the terminal 350 and is converted to the frequency-domain representation in the Fourier transform unit 352. The spectrum of the frame is then submitted to the signal power computation unit 354. The output is the power of the detected signal of interest. It is then send to the accumulator-comparator unit 356.

The unit 356 operates by storing the values of the signal power for a number of recently seen signal frames. Upon the availability of the new value for the signal power, the unit 356 compares it with the stored values to determine if a consistent trend of increasing or decreasing signal power is observed. The unit 356 outputs "false" if the signal's power is decreasing over time, suggesting a receding sound, and "true" otherwise.

The spectrum of the signal frame is also submitted to the pitch detector 358 and to the harmonics extractor 360. The pitch detector 358 is a device well-known to one skilled in art. It executes a numeric algorithm to detect a pitch of the incoming signal and outputs the detected pitch. The harmonics extractor 360 detects the presence of peaks in the spectrum of the sound and outputs their frequencies. Outputs of units 358 and 360 are sent to the Doppler shift detector 362. It is well known from physics that a harmonic sound subject to Doppler shift loses the harmonistic property, as the fundamental frequency and all the harmonics shift by the same number of Hz and the frequencies of harmonics are no longer integer multiplicatives of the fundamental frequency. As such, if the sound is approaching (receding), the frequencies of harmonics are consistently lower (higher, correspondingly) than the integer multiplicatives of a pitch. The Doppler shift detector 362 detects whether the sound appears to be receding according to these rules and outputs "true" if it indeed appears to be receding. Otherwise, it outputs "false".

The logic unit 364 takes inputs from the accumulator-comparator 356, from the Doppler shift detector 362, and from the "operation-enable" terminal 366 and outputs, to the terminal 368, a single Boolean value according to logical "AND" rule as follows: the output is "true" if and only if all three inputs are "true". As such, if the "operation-enable" terminal 366 is "false" (i.e., no signal of sufficient power is detected in the environment), the output of the unit is forced to be "false". The "operation-enable" terminal 366 can also be used to disable operation of the localization unit 164 altogether by, e.g., putting the semiconductor components comprising the unit into low-power-consumption ("sleep") mode so as to conserve power for unattached operations. When "operation-enable" terminal 366 is "true", a sound deemed to be receding by at least one method (volume over time or Doppler shift) is deemed to be receding by the whole unit ("false" at the terminal 368) so that no system's reaction is necessary. Otherwise, the sound is either stationary or approaching ("true" at the terminal 368), and a reaction such as audio playback muting or amplification of the detected sound may be necessary. The output of the localization unit 164 is sent to the relevance detecting unit 166.

Figure 8:
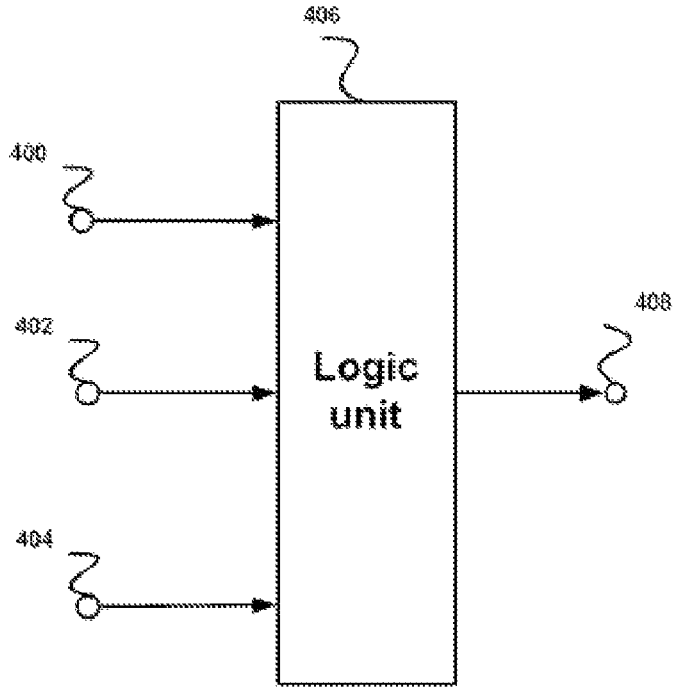
FIG. 8 is a block diagram of a relevance detecting unit as shown in FIG. 3 in accordance with an exemplary embodiment.

Referring to FIG. 8, a block diagram of the relevance detecting unit 166 according to one embodiment is shown. The relevance detecting unit 166 is a logic unit 406 that can include three input terminals (400, 402, and 404) and one output terminal 408. Input terminal 400 is connected to the logic unit 406 and provides a Boolean value to the logic unit 406 indicating whether the spectral pattern of the detected signal matches the characteristics of auditory signals. Input terminal 402 is connected to the logic unit 406 and provides a Boolean value to the logic unit 406 indicating whether the temporal pattern of the detected signal matches the characteristics of auditory signals. Input terminal 404 is connected to the logic unit 406 and provides a Boolean value to the logic unit 406 whether the signal appears approaching ("true") or receding ("false"). The logic unit 406 executes a numeric algorithm based on the unit's inputs and generates a Boolean value at the output of the logic unit 406, which is connected to the output terminal 408 of the relevance detecting unit 166. The specific algorithm describing operations of the relevance detecting unit 166 is specified below.

The relevance detecting unit 166 determines whether the auditory signal possibly detected in the environment is relevant and to signal its occurrence to the sound control unit 178 (FIG. 3). To accomplish that, the relevance detecting unit 166 accepts information about spectral characteristics of the signal via terminal 400 from the spectral pattern detecting unit 160, about temporal characteristics of the signal via terminal 402 from the temporal pattern detecting unit 162, and about the estimated sound source direction (towards the listener or away from the listener) via terminal 404 from the localization unit 164. The relevance detecting unit 166 also implicitly receives information about the volume of the signal, as the volume detecting unit 158 enables operations of the spectral pattern detecting unit 160, of the temporal pattern detecting unit 162, and of the localization unit 164 if and only if the signal volume matches criteria for an auditory signal; as such, if the volume of the signal is low, there will be no inputs to the relevance detecting unit 166. The logic unit 406 is responsible for determining whether the detected sound is relevant based on sound's volume, spectral and temporal properties, and direction. The output of unit 406 is determined according to the following rules:

a) If input at the terminal 404 is "false", the output is "false".

b) If input at the terminal 404 is "true" and input at the terminal 400 is "true", then the output is "true".

c) If input at the terminal 404 is "true" and input at the terminal 402 is "true", then the output is "true".

d) Otherwise, the output is "false".

Thus, environmental signals are deemed relevant danger signals if they are not receding and satisfy at least one out of two (spectral pattern and temporal pattern) criteria characteristic of auditory signals. The output of the unit 406 is passed to the output terminal 408 of the relevance detecting unit to signal to the signal control unit whether the auditory signal is presented in the environment warranting interruption of music playback for safety of the listener.

Figure 9:
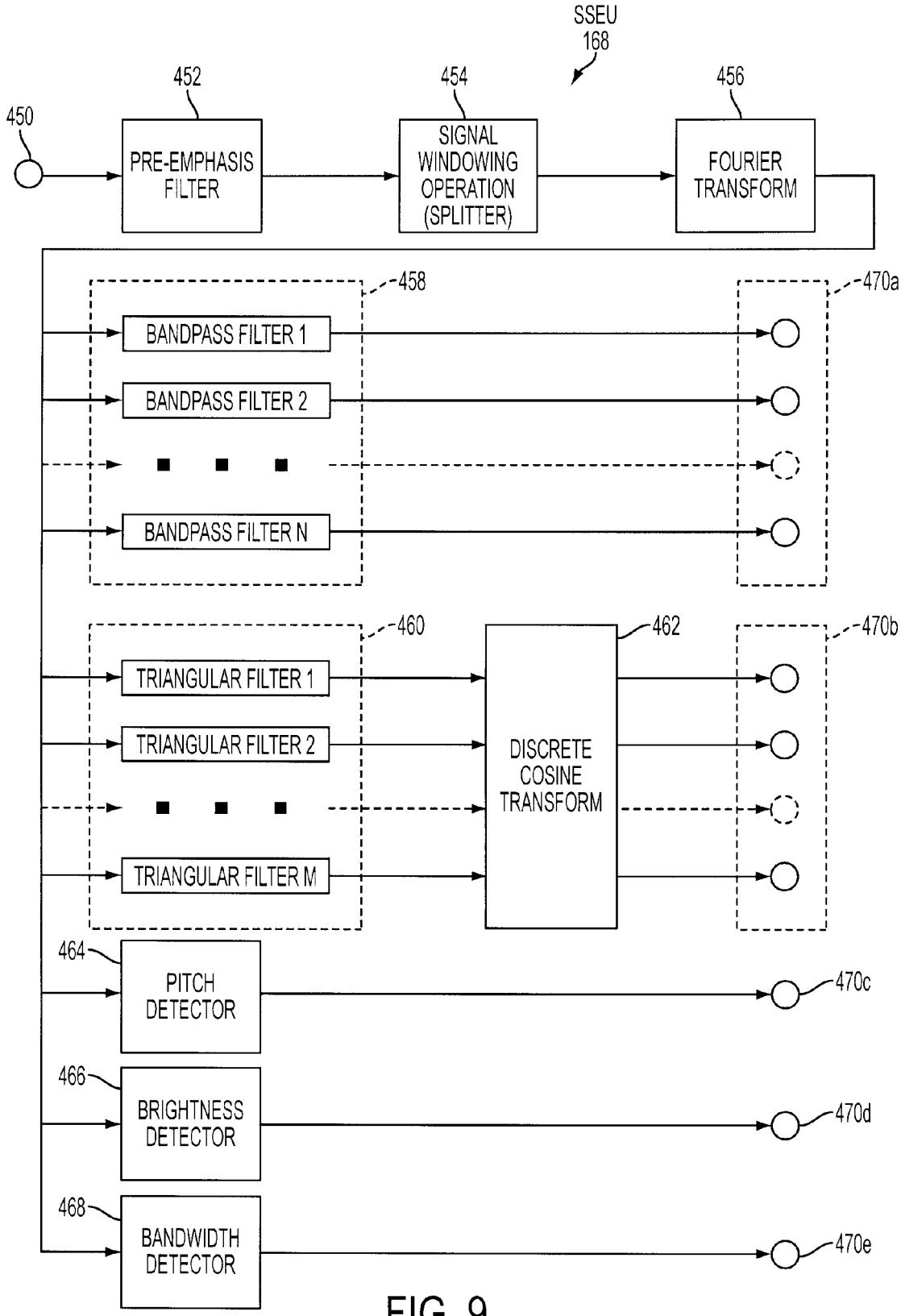
FIG. 9 is a block diagram of a sound signature extracting unit as shown in FIG. 3 in accordance with an exemplary embodiment.

Referring to FIG. 9, a block diagram of the sound signature extracting unit 168 according to one embodiment is shown. The sound signature extracting unit 168 processes the incoming sound in order to extract salient features used for identifying sounds of interest such as alert words, desirable sounds, and undesirable sounds. The exact features being extracted can vary. The preferred embodiment of the unit uses a combination of perceptual and cepstral features. The former include total signal power, bandwidth power for several frequency bands, pitch frequency, brightness, and bandwidth. The latter are comprised of mel-frequency cepstral coefficients (MFCCs).

The sound signature extracting unit 168 is comprised of the terminal 450 for the input of the digitized signal, connected to the pre-emphasis filter 452, which in turn is connected to the splitter 454 programmed to perform a windowing operation. The frame of the signal appearing at the output of the splitter 454 is passed to the Fourier transform operation 456. The output of the Fourier transform operation 456 is connected, in parallel, to two filterbanks (bandpass filterbank 458 and triangular filterbank 460) and to signal parameter detectors (pitch detector 464, brightness detector 466, and bandwidth detector 468). Bandpass filterbank 458 is a device commonly used in electronics and in engineering and is known to one skilled in the art. The outputs 470*a* of the filterbank 458 contain the numerical values of the total signal power and of the signal power in several frequency bands. They form a part of the sound signature.

The filterbank 460 and the discrete cosine transformation algorithm 462 together compute the MFCCs of the signal frame. As dictated by standard MFCC computation algorithm well-known to one skilled in the art, filters in the triangular filterbank 460 have a triangular shape of the passing window and the output of the triangular filterbank 460 is subjected to the discrete cosine transformation (DCT) 462. The outputs 470*b* of the DCT contain the numerical values for MFCCs and also form a part of the sound signature.

The output of the splitter 454 is also connected to a pitch detector 464 employing a numeric algorithm for computing the pitch of the signal frame. The numeric output 470*c* of the pitch detector is also a part of the sound signature.

The output of the splitter 454 is also connected to the brightness detector 466 employing a numeric algorithm to compute the brightness of the signal frame. Brightness is computed in accordance with its common definition as the centroid of the spectrum. The numeric output 470*d* of the brightness detector is also a part of the sound signature.

The output of the splitter 454 is also connected to the bandwidth detector 468 employing a numeric algorithm to compute the bandwidth of the signal frame. Bandwidth is computed in accordance with its common definition as the second momentum of the spectrum. The numeric output 470*e* of the bandwidth detector is also a part of the sound signature.

The output 470 of the sound signature extracting unit thus constitute a vector of several numerical values ("sound signature") combined, in the described case, from the total signal power, signal power in several frequency bands, mel-frequency cepstral coefficients computed from the signal, and the signal pitch, brightness, and bandwidth.

In the foregoing, a brief description of the operation of the sound signature extracting unit 168 is provided. The sound signature extracting unit 168 accepts a digitized input signal via the input terminal 450. The signal is then subject to the pre-emphasis filtering done by the filter 452 with pre-emphasis parameter 0.96. The pre-emphasized signal is then split into overlapping frames of fixed size, and each frame is windowed by a Hamming window in the splitter 454. Each frame is then subjected to the Fourier transform operation in the block 456, resulting in the spectrum of the frame at the output of the block 456. The spectrum is submitted to the bandpass filterbank 458, which computes using simple summation over frequencies the total power of the signal and the power of the signal in several frequency bands and outputs the total and the band-wise powers to output terminals 470*a*.

The spectrum of the frame is also submitted to the blocks 460 and 462, which together compute mel-frequency cepstral coefficients of the signal frame. Block 460 filters the spectrum with triangular-shaped bandpass filters arranged on the mel-frequency scale and produces an ordered list of signal powers at the outputs of the filters. Block 462 performs the DCT of this list as if it were the signal. The DCT outputs constitute the mel-frequency cepstral coefficients and are sent to the output terminals 470*b*

The spectrum of the frame is also submitted to the pitch detector 464. The detector executes a numeric pitch detection algorithm to determine whether the pitch is present in the signal and what it is. The pitch detector outputs the pitch value (or a pre-determined constant, such as 0 or −1, in case no pitch is detected) to the output terminal 470*c*. The spectrum of the frame is also submitted to the brightness detector 466. The detector executes a numeric algorithm to compute the centroid of the spectrum and outputs the computed value to the output terminal 470*d*. The spectrum of the frame is also submitted to the bandwidth detector 468. The detector executes a numeric algorithm to compute the second momentum of the spectrum (the power-weighted average of the squared difference between spectrum components and spectrum centroid) and outputs the computed value to the output terminal 470*e*.

Briefly, the sound signature extracting unit 168 accepts the digitized input signal via the terminal 450. As follows from FIG. 3, in the final system it is connected to the output of analog-to-digital converter 156 of FIG. 3. The sound signature extracting unit 168 executes several algorithms named above, computes the numeric signature of the sound, and outputs it to the terminals 470*a*, 470*b*, 470*c*, 470*d*, and 470*e*. These terminals comprise the set of output terminals 470. The sound signature thus is produced and is sent either to the sound signature storage 174 or to the sound signature comparing unit 172 depending on whether the system is currently in learning mode or in operation mode, respectively.

Figure 10:
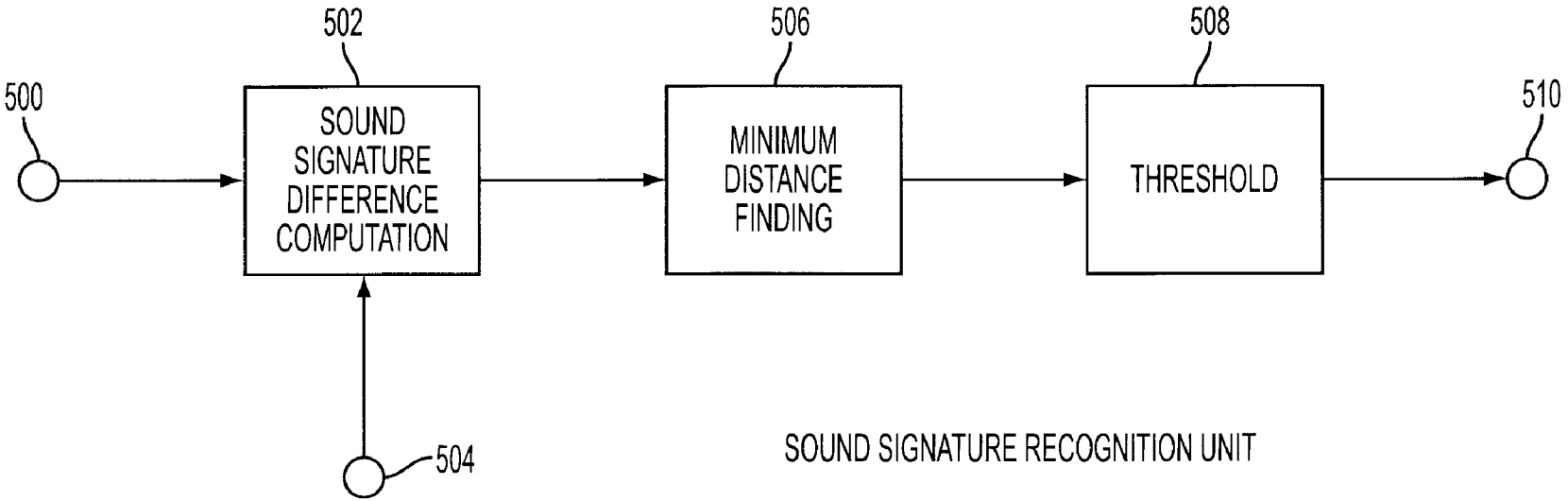
FIG. 10 is a block diagram of a sound signature recognition unit as shown in FIG. 3 in accordance with an exemplary embodiment.

Referring to FIG. 10, a block diagram of the sound signature comparing unit 172 according to one embodiment is shown. The input terminal 500 is connected to the sound signature difference computation unit 502. The sound signature storage connector terminal 504 is also connected to the unit 502. Output of the unit 502 is connected to the minimum distance finding unit 506, which is connected in turn to the thresholding unit 508. The output of the thresholding unit 508 is fed to the output terminal 510.

The sound signature comparing unit 172 performs a recognition of the ambient sound by comparing its signature extracted by the unit 168 of FIG. 3 with signatures of all sound known to the system stored in the signature storage 174 of FIG. 3. Accordingly, the sound signature comparing unit 172 accepts the sound signature of the ambient sound via the terminal 500 and has access to the sound signatures of all sounds stored in the system via terminal 504. Input from the terminal 500 is transmitted to the difference computation unit 502.

The term "distance between signatures" is herein defined to mean the numeric measure of dissimilarity between two sound signatures, computed using some numeric algorithm. The exact choice of algorithm is not critical for providing the system with behavior in accordance with the current patent application. The simplest choice of such algorithm would be to compute a normalized Euclidian or Mahalanobis distance between two sound signatures, which are nothing but two numeric vectors. More advanced algorithms can be applied such as multi-dimensional sound signature classification with support vector machines or with neural networks. However, those require auxiliary data structures computed and stored in the signature storage unit 174 together with actual sound signatures in order to achieve reasonable processing speed. In addition, those data structures will have to be updated every time a new sound of interest is taught to the system and is stored in the signature storage unit 174. It will inevitably be a balancing act between computational speed, memory requirements, and update complexity of various algorithms in choosing the one for implementation.

The unit 502 executes such algorithm to compute a set of distances between the sound signature obtained via terminal 500 and all sound signatures in the sound signature storage accessed via connector 504. The result of the computation is sent to the minimum distance finding unit 506. The unit 506 accepts the set of distances from the current ambient sound to all sounds of interest to the system and selects the numerically minimal distance from the set. The value of the minimal distance, along with the class of the signal (alert word, desirable, or undesirable), with the optional sound replacement information for the signal, and with the list of the frequency bands occupied by the detected signal, is sent to the thresholding unit 508, which compares the distance with a predetermined threshold. If the distance is less than a threshold, a decision is made that the sound is recognized and a flag indicative of such decision is sent to the output terminal 510 along with the class of the signal, with the optional sound replacement information for the signal, and with the list of frequency bands of the detected signal. If the distance is more than a threshold, a decision is made that no sounds of interest are present in the environment and a flag indicative of such decision is sent to the terminal 510.

Figure 11:
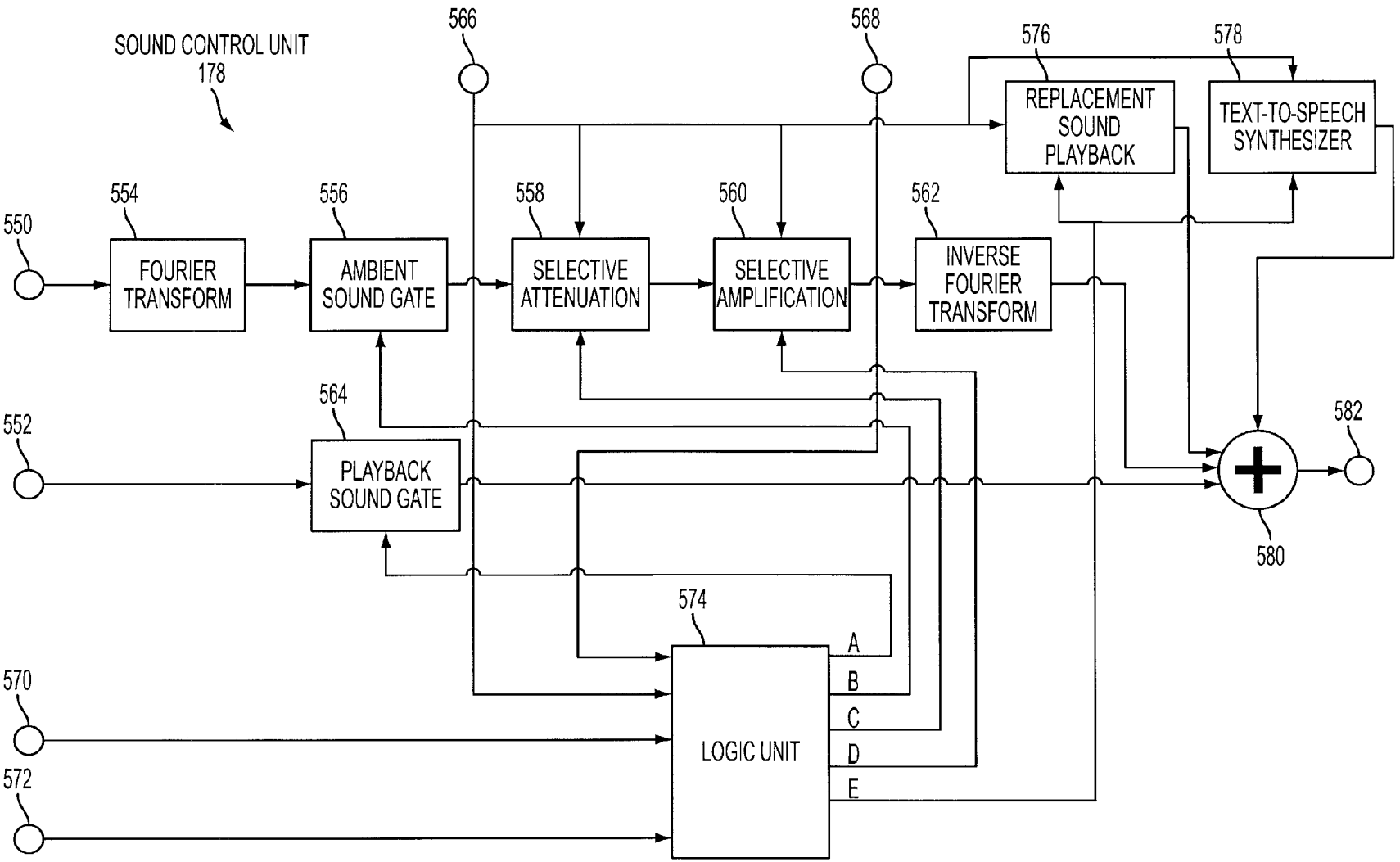
FIG. 11 is a block diagram of a sound control unit as shown in FIG. 3 in accordance with an exemplary embodiment.

Referring to FIG. 11, a block diagram of the sound control unit 178 according to one embodiment is shown. The sound control 178 unit has two terminals for sound input. The ambient sound terminal 550 is connected to the Fourier transform unit 554. The output of the Fourier transform unit 554 is connected to the ambient sound gating unit 556. Gating is controlled by output B of the logic unit 574. The output of the gating unit 556 is connected to the selective attenuation unit 558. Activation of the selective attenuation unit 558 is controlled by output C of the logic unit 574. The output of the selective attenuation unit 558 is connected to the selective amplification unit 560 similarly controlled by output D of the logic unit 574. The output of the selective amplification unit 560 is connected to the inverse Fourier transform unit 562. Output of the unit 562 is connected to the first input of the four-input summation unit 580. The playback sound terminal 552 is connected to the playback sound gating unit 564, controlled by the output A of the logic unit 574. Output of the unit 564 is connected to the second input of the four-input summation unit 580.

The sound control unit 178 also has two terminals for input of information pertaining to the detection of signals of interest to the system (terminal 566) and specifically of auditory signals (terminal 568). Via terminal 566, information comprised of the class of the detected signal of interest, of its optional sound replacement information, and of frequencies occupied by the signal of interest arrives. Terminal 566 is connected to selective attenuation and amplification units 558 and 560, to the replacement sound playback unit 576, to the text-to-speech (TTS) synthesizer 578, and to the logic unit 574. Terminal 568 is connected only to the logic unit 574 to allow for action-taking when an auditory signal is detected.

The logic unit 574 is actually responsible for the control of the sound. It has four inputs and five outputs. Four inputs are: the already described terminals 566 and 568; the operation mode switch terminal 570 via which the user of the system sets the current mode of operation; and the sound replacement enable terminal 572 via which the user of the system enables or disables the sound replacement mode for sounds that have associated sound replacement information. Five outputs of the logic unit 574 are named A, B, C, D, and E in the drawing, for ease of reference, and are connected to the playback sound gating unit 564, to the ambient sound gating unit 556, to the selective attenuation unit 558, to the selective amplification unit 560, and to both the replacement sound playback unit 576 and the text-to-speech converter 578, respectively. The logic unit operates in accordance with the rules described in the next section.

The replacement sound playback unit 576 is used to render to the user the replacement sound associated with the detected environmental sound. Terminal 566 is connected to the replacement sound playback unit 576 for transmission of the sound replacement information, which may include the replacement sound associated with the detected sound. If no replacement sound is associated with the detected sound, the replacement sound playback unit 576 does not produce any output. The output E of the logic unit 574 is also connected to the replacement sound playback unit 576 for enabling/disabling its operation. The output of the replacement sound playback unit 576 is connected to the third input of the four-input summation unit 580.

The TTS converter 578 is used to announce the occurrence of sounds of interest in the environment. Terminal 566 is connected to the TTS converter 578 for transmission of the sound replacement information, which may include the textual label of the sound. If no textual label is associated with detected sound, the TTS converter 578 does not produce any output. The output E of the logic unit 574 is also connected to the TTS converter 578 for enabling/disabling its operation. The output of the TTS converter 578 is connected to the fourth input of the four-input summation unit 580.

The summation unit 580 sums up the outputs of the inverse Fourier transform unit 562, of the playback sound gating unit 564, of the replacement sound playback unit 576, and of the TTS converter 578 and is connected to the output terminal 582 for the in-ear loudspeaker.

In the foregoing, a brief description of the operation of the sound control unit 178 is provided. The sound control unit 178 executes actions based on the recognized sounds of interest to the system. Depending on the current mode of operation, set by two switches connected to the terminals 570 and 572, the action can be different.

Via the terminal 566, the information about a recognized sound of interest arrives when such sound occurs. The information includes the class of sound (alert word, desirable sound, or undesirable sound), optional sound replacement information associated with the detected sound, and the list of particular frequency bands occupied by the detected sound. Via the terminal 568, the information of whether the relevant auditory signal is detected arrives. In logic unit 574, reaction to auditory signals takes precedence over any reaction to the other signals of interest.

Via the terminal 550, ambient sound arrives. It is then subject to the Fourier transform in the unit 554 and can be turned on or off with ambient sound gating unit 556 controlled by the output B of the logic unit 574. It can be further selectively attenuated by unit 558 or amplified by unit 560 at frequencies specified in the information transmitted via terminal 566. Activation of the units 558 and 560 is controlled by outputs C and D of the logic unit 574, respectively. The ambient sound is then subject to inverse Fourier transform done by unit 562 in order to convert the signal back to the time domain and is passed to the output terminal 582 and thus to the user of the system via summation unit 580.

Via the terminal 552, playback sound arrives. It can be turned on or off with playback sound gating unit 564 controlled by output A of the logic unit 574. It is then passed to the output terminal 582 and thus to the user of the system via summation unit 580.

The sound replacement capability is based on replacement sound playback unit 576 and TTS converter 578. Activation of the sound replacement capability is controlled by the output E of the logic unit 574. When sound replacement mode is active, if sound replacement information contains the replacement sound (the textual label) associated with detected sound, the replacement sound playback unit 576 (the TTS converter 578) activates and renders the replacement sound (translates to speech the textual label, respectively) associated with the detected environmental sound arriving via sound signature information terminal 566. Outputs of the replacement sound playback unit 576 and of the TTS converter 578 are passed to the output terminal 582 and thus to the user of the system via summation unit 580. In addition, when sound replacement mode is active, the original detected sound is attenuated by the selective attenuation unit 558 so that the original sound is not heard by the user and only the replacement sound or textual recitation is heard.

The logic unit 574 controls six units (564, 556, 558, 560, 576, and 578) with five outputs named A, B, C, D, and E, respectively. Unit 564 passes through the playback signal only if output A of the unit 564 is "true". Unit 556 passes through the ambient signal only if output B of the unit 564 is "true". Unit 558 selectively attenuates the frequencies defined in the information arriving via the terminal 566 only if output C of the unit 574 is "true". Unit 560 selectively amplifies the frequencies defined in the information arriving via the terminal 566 only if output D of the unit 574 is "true". Unit 576 performs rendering of the replacement sound contained in the information arriving via the terminal 566 only if output E of the unit 574 is "true". Unit 578 performs TTS conversion of the textual label contained in the information arriving via the terminal 566 only if output E of the unit 574 is "true".

The system's mode of operation is selected by the user via the switch connected to the terminal 570. Four modes of operation are possible: transparency, amplification, attenuation, and playback. In addition, the user may enable sound replacement mode (SRM) via the switch connected to the terminal 572. For each possible combination of switches 570 and 572, the rules of operation for the logic unit 574 are listed below as values of outputs A, B, C, D, and E, respectively, abbreviated to five letters with T meaning "true" and F meaning "false".

Mode: Transparency, SRM Disabled
Recognized Auditory signal: Unit 574 output: FTFFF
Recognized Alert Word: Unit 574 output: FTFFF
Recognized Desirable Sound: Unit 574 output: FTFFF
Recognized Undesirable Sound: Unit 574 output: FTFFF
No Signal Of Interest Recognized: Unit 574 output: FTFFF
Mode: Transparency, SRM Enabled
Recognized Auditory signal: Unit 574 output: FTFFF
Recognized Alert Word: Unit 574 output: FTTFT
Recognized Desirable Sound: Unit 574 output: FTTFT
Recognized Undesirable Sound: Unit 574 output: FTFFF
No Signal Of Interest Recognized: Unit 574 output: FTFFF
Mode: Amplification, SRM Disabled
Recognized Auditory signal: Unit 574 output: FTFFF
Recognized Alert Word: Unit 574 output: FTFFF
Recognized Desirable Sound: Unit 574 output: FTFTF
Recognized Undesirable Sound: Unit 574 output: FTFFF
No Signal Of Interest Recognized: Unit 574 output: FTFFF
Mode: Amplification, SRM Enabled
Recognized Auditory signal: Unit 574 output: FTFFF
Recognized Alert Word: Unit 574 output: FTFFF
Recognized Desirable Sound: Unit 574 output: FTTFT
Recognized Undesirable Sound: Unit 574 output: FTFFF
No Signal Of Interest Recognized: Unit 574 output: FTFFF
Mode: Attenuation, SRM Disabled or Enabled
Recognized Auditory signal: Unit 574 output: FTFFF
Recognized Alert Word: Unit 574 output: FTFFF
Recognized Desirable Sound: Unit 574 output: FTFFF
Recognized Undesirable Sound: Unit 574 output: FTTFF
No Signal Of Interest Recognized: Unit 574 output: FTFFF
Mode: Playback, SRM Disabled
Recognized Auditory signal: Unit 574 output: FTFFF
Recognized Alert Word: Unit 574 output: FTFTF
Recognized Desirable Sound: Unit 574 output: TTFTF
Recognized Undesirable Sound: Unit 574 output: TFFFF
No Signal Of Interest Recognized: Unit 574 output: TFFFF
Mode: Playback, SRM Enabled
Recognized Auditory signal: Unit 574 output: FTFFF
Recognized Alert Word: Unit 574 output: FTTFT
Recognized Desirable Sound: Unit 574 output: TTTFT
Recognized Undesirable Sound: Unit 574 output: TFFFF
No Signal Of Interest Recognized: Unit 574 output: TFFFF As can be seen from the tables above, the auditory signal takes priority and the system interrupts sound playback and goes to the state equivalent to the transparency mode if a danger signal is recognized. Several other actions detailed in the table are also taken to react to alert words with possible textual announcement, to amplify desired sounds, and to eliminate undesired sounds based on the current operation mode. In transparency mode, the system does not take any action at all as the person just hears the outside world as he/she would hear it without headphones, and if sound replacement mode is active, the detection of an alert word or of a desirable sound triggers attenuation of that sound and rendering of the replacement sound instead.

One of the advantages of the present invention is the convenient automatic shutdown of audio content playback if an auditory signal is detected in the environment. Another advantage is reduction of unnecessary/unwanted/harmful sounds. For example, in the dentist's office the constant noise of the dentist drill inhibits communication between the doctor and the patient and contributes to the noise-induced hearing loss common to the occupation of dentist. Both of these problems can be solved if a sound of a dentist drill is filtered out with the present listening device.

Yet another advantage is localization and amplification of sounds of interest to the wearer with optional interruption of playback upon detection of such sounds, thereby improving the situation awareness and listening acuity of the user. The listening system may be implemented in several modifications to suit various needs and fall into various price ranges, such as the system having only the ability to recognize basic danger signals (car horn, ambulance siren, etc.) and disable audio playback upon such detection; the system having additional ability to recognize and localize sounds of interest and perform amplification, attenuation, TTS conversion, and sound replacement, with some basic sounds pre-programmed into the system; and fully customizable system having expanded sound storage and sound recognition capabilities (e.g., recognizing alert words in many languages), ability to download sound signatures for specific sounds of interest to the particular user (such as a bike bell for joggers), and the ability to learn new sounds of interest by playing such sound to the system in the training mode and assigning appropriate action to the learned sound.

In one embodiment, the system can be employed in an automobile audio scenario. It is a relatively common occurrence for the driver of the car to play loud music in the car, thereby hindering his/her ability to hear sounds of emergency vehicles and car horns of other cars. The described system can be modified to be used in such a scenario by automatically shutting down the playback of music if/when such an emergency sound is detected.

Another specific application is use of the system in search and rescue tasks. Currently, firefighters countrywide use a PASS (Personal Alert Safety System) apparatus. PASS is typically a small box mounted on the belt of the wearer and is configured to emit a loud tone when a person wearing it remains motionless for a pre-determined period of time, suggesting that he is unconscious, is stuck in or under debris, has fallen to the floor, etc. Another firefighter using the personal listening device described herein tuned to the alert produced by PASS and set to amplification and localization mode can use the information provided by the device, such as direction and distance to the source, to find the disabled firefighter by literally moving so as the reported direction to the source decreases.

In another embodiment, a personal listening device incorporating aspects of the disclosed invention can be worn throughout the day by the person and provide a comfortable and safe listening experience. The personal listening device can also include capabilities for monitoring of the sound exposure for the purposes of hearing loss prevention; for wireless integration with communication devices (e.g., for notification of incoming e-mail); for frequency response normalization according to the user's ear anatomy and personal preferences; etc.

While a specific embodiment has been illustrated above containing many specificities and implementation details, these should not be construed as limiting the scope of the invention but as merely providing illustrations as to how to build and operate a presently preferred embodiment. Numerous modifications and departures from the exact description above are possible without departing from the nature and the essence of the invention. For example, different sound recognition and classification algorithms may be used; the signal processing may be done in the unit external to the headphones (e.g., located on the belt of the wearer); different circuitry may be used to discern auditory signals; etc. Thus the scope of this invention should be determined by the appended claims and their legal equivalents, rather than by the examples given.

What is claimed is:

1. A listening device, comprising:

a) means for directing a sound produced by a receiver into an ear of a user;

b) means for mounting a microphone so as to receive a further sound in an environment surrounding said user;

c) detecting means for detecting an auditory signal in the further sound received by said microphone, said detecting means determining a sound signature of the further sound, the sound signature having a vector of numerical values identifying said further sound, the sound signature of the further sound being compared with a plurality of predetermined sound signatures to detect the auditory signal; and d) alerting means for alerting said user to the presence of said auditory signal detected by said detecting means.

2. The listening device of claim 1 wherein said alerting means comprises a controllable electronic valve arranged to shut off the receiver upon detection of said auditory signal by said detecting means.

3. The listening device of claim 1 wherein said detecting means comprises:

a) first means for detecting whether a volume of the further sound received by said microphone is more than a predetermined level;

b) second means for detecting whether a spectral pattern of the further sound received by said microphone is characteristic of said auditory signal;

c) third means for detecting whether a temporal pattern of the further sound received by said microphone is characteristic of said auditory signal;

d) fourth means for detecting whether the further sound received by said microphone is approaching or receding from the listening device; and e) fifth means for combining the outputs of said first, second, third, and fourth means.

4. The listening device of claim 3 wherein said predetermined level is set at least to about 65 dB.

5. The listening device of claim 3 wherein said second means consist of:

a) means for detecting whether a signal-to-noise ratio is more than about 13 dB in at least one one-third-octave-wide frequency band;

b) means for detecting whether the signal-to-noise ratio is more than about 10 dB in at least one one-octave-wide frequency band; and c) means for detecting whether the signal-to-noise ratio is more than about 15 dB, all enjoined by the logical OR operator.

6. The listening device of claim 3 wherein said third means comprises a periodicity detector and a pitch detector arranged to activate upon detection of a sound with a period between about 0.5 Hz and about 4 Hz and a pitch between about 500 Hz and about 1000 Hz, respectively.

7. The listening device of claim 3 wherein said fourth means is arranged to operate by analyzing a sound level over time and by analyzing Doppler shifts in a sound spectrum of the further sound.

8. A listening device comprising:

a) means for directing a sound produced by a receiver into an ear of a user;

b) means for mounting a microphone so as to receive a further sound in an environment surrounding said user;

c) recognition means for recognizing at least one predetermined environmental sound from the further sound, said recognition means including first means for determining a sound signature of the further sound, the sound signature having a vector of numerical values identifying said further sound, the sound signature of the further sound being compared with a plurality of predetermined sound signatures to recognize the at least one environmental sound; and d) action means for performing at least one predetermined action upon recognition of said at least one predetermined environmental sound.

9. The listening device of claim 8 wherein said recognition means comprise:

a) second means for storing the plurality of predetermined sound signatures; and b) third means for comparing the sound signature of the further sound with said plurality of predetermined sound signatures stored by said second means, where the third means for comparing determines a best-matching sound signature.

10. The listening device of claim 9 wherein said third means is arranged to operate using a distance between said plurality of predetermined sound signatures, using at least one of a support vector machine (SVM) classifier, a neural network classifier, or a mixture of Gaussians classifier.

11. The listening device of claim 9, further including fourth means for directing said sound signature determined by the first means into a sound signature storage provided by the second means.

12. The listening device of claim 8 wherein said vector of numerical values comprises at least one among a total power of said further sound, powers of said further sound in predetermined frequency bands, mel-frequency cepstral coefficients of said further sound, a pitch of said further sound, a bandwidth of said further sound, and a brightness of said further sound.

13. The listening device of claim 8, further including localization means for determining at least one among a location, a direction and a distance of said further sound with respect to said user.

14. The listening device of claim 13 wherein said localization means is arranged to operate using one or more acoustic cues selected from the group consisting of:

a) level or intensity differences between the signals received at left and right ears;

b) phase differences between the signals received at the left and right ears;

c) a level or intensity variation over time for the signals received at the left and right ears; and d) a phase variation over time for the signals received at the left and right ears.

15. The listening device of claim 8 wherein said action means comprise one or more means selected from the group consisting of:

a) first means for selectively amplifying said at least one predetermined environmental sound recognized by said recognition means;

b) second means for selectively attenuating said at least one predetermined environmental sound recognized by said recognition means;

c) third means for alerting said user to said at least one predetermined environmental sound recognized by said recognition means by reciting a textual label pre-associated with said predetermined environmental sound to said user by means of a text-to-speech synthesizer;

d) fourth means for alerting said user to said at least one predetermined environmental sound recognized by said recognition means by rendering a specific sound pre-associated with said predetermined environmental sound to said user;

e) fifth means for alerting said user to said at least one predetermined environmental sound recognized by said recognition means by reciting information indicative of how far and in which direction said predetermined environmental sound is located;

f) sixth means for alerting said user to said at least one predetermined environmental sound recognized by said recognition means by discontinuing a playback of any audio content being played over said listening device; and g) seventh means for associating an indicator of which particular action or actions, from the list above, are executed upon detection of said at least one predetermined environmental sound.

16. A method for constructing a audio listening device, comprising:

a) providing means for directing a sound produced by a receiver into an ear of a user;

b) providing means for mounting a microphone so as to receive a further sound in an environment surrounding said user;

c) providing detecting means for detecting an auditory signal in further sound received by said microphone, said detecting means determining a sound signature of the further sound, the sound signature having a vector of numerical values identifying said further sound, the sound signature of the further sound being compared with a plurality of predetermined sound signatures to detect the auditory signal; and d) providing alerting means for alerting said user to the presence of said auditory signal detected by said detecting means.

17. The method of claim 16 wherein said alerting means comprises a controllable electronic valve arranged to shut off the receiver upon detection of said auditory signal by said detecting means.

18. The method of claim 16 wherein said detecting means comprises:

a) first means for detecting whether a volume of the further sound received by said microphone is more than a predetermined level;

b) second means for detecting whether a spectral pattern of the further sound received by said microphone is characteristic of said auditory signal;

c) third means for detecting whether a temporal pattern of the further sound received by said microphone is characteristic of said auditory signal;

d) fourth means for detecting whether the further sound received by said microphone is approaching or receding from said user; and e) fifth means for combining outputs of said first, second, third, and fourth means.

19. A method for constructing an audio listening device, comprising:

a) providing a receiver and means for directing a sound produced by said receiver into an ear of a user;

b) providing means for mounting a microphone so as to receive a further sound in an environment surrounding the user;

c) providing recognition means for recognizing at least one predetermined environmental sound from the further sound, said recognition means including first means for determining a sound signature of the further sound, the sound signature having a vector of numerical values identifying said further sound, the sound signature of the further sound being compared with a plurality of predetermined sound signatures to recognize the at least one environmental sound; and d) providing action means for performing at least one predetermined action upon recognition of said at least one predetermined environmental sound.

20. The method of claim 19 wherein said recognition means comprise:

a) second means for storing the plurality of predetermined sound signatures; and b) third means for comparing the sound signature of said further sound with said plurality of predetermined sound signatures stored by said second means and for determining a best-matching sound signature.

21. The method of claim 20 wherein said third means is arranged to operate using a distance between said sound signatures, using at least one of a support vector machine (SVM) classifier, a neural network classifier, or a mixture of Gaussians classifier.

22. The method of claim 20, further including fourth means for directing said sound signature determined by the first means into a sound signature storage provided by the second means, wherein a listening device queries the sound signature storage to recognize, and act upon recognition of new sound signatures.

23. The method of claim 19 wherein said vector of numerical values comprises at least one of a total power of said further sound, powers of said further sound in predetermined frequency bands, mel-frequency cepstral coefficients of said further sound, a pitch of said further sound, a bandwidth of said further sound, and a brightness of said further sound.

24. The method of claim 19, further including localization means for determining at least one among a location, a direction, and a distance of said further sound with respect to said user, wherein said localization means is arranged to operate using one or more acoustic cues selected from the group consisting of:

a) level or intensity differences between the signals received at left and right ears;

b) phase differences between the signals received at the left and right ears;

c) a level or intensity variation over time for the signals received at the left and right ears; and d) a phase variation over time for the signals received at the left and right ears.

25. A method for acute sound detection and reproduction, the method comprising:

measuring an external ambient sound in an ear canal at least partially occluded by an earpiece;

detecting an acute sound in the external ambient sound, by determining a sound signature of the external ambient sound and comparing the sound signature of the external ambient sound with a plurality of predetermined sound signatures, the sound signature having a vector of numerical values identifying the external ambient sound;

monitoring a change in a level of the external ambient sound from the sound signature of the external ambient sound;

determining whether a sound source producing the acute sound is approaching or departing; and reproducing the acute sound within the ear canal responsive to detecting the acute sound based on the step of determining.

* * * * *

UNITED STATES PATENT AND TRADEMARK OFFICE

CERTIFICATE OF CORRECTION

PATENT NO. : 8,194,865 B2
APPLICATION NO. : 12/035873
DATED : June 5, 2012
INVENTOR(S) : Steven W. Goldstein et al.

It is certified that error appears in the above-identified patent and that said Letters Patent is hereby corrected as shown below:

Column 29, claim 16, line 27, after the word "in" please insert the word --the--.

Signed and Sealed this
Tenth Day of July, 2012

David J. Kappos

David J. Kappos
*Director of the United States Patent and Trademark Office*